US010894415B2

(12) United States Patent
Kato et al.

(10) Patent No.: US 10,894,415 B2
(45) Date of Patent: Jan. 19, 2021

(54) LIQUID DISCHARGE HEAD

(71) Applicant: BROTHER KOGYO KABUSHIKI KAISHA, Nagoya (JP)

(72) Inventors: Yasuo Kato, Aichi-ken (JP); Toru Kakiuchi, Aichi-ken (JP); Yuichi Ito, Mie-ken (JP)

(73) Assignee: BROTHER KOGYO KABUSHIKI KAISHA

( * ) Notice: Subject to any disclaimer, the term of this patent is extended or adjusted under 35 U.S.C. 154(b) by 0 days.

(21) Appl. No.: 16/434,926

(22) Filed: Jun. 7, 2019

(65) Prior Publication Data

US 2020/0079092 A1 Mar. 12, 2020

(30) Foreign Application Priority Data

Sep. 11, 2018 (JP) ..... 2018-169430

(51) Int. Cl.
*B41J 2/14* (2006.01)
*B41J 2/175* (2006.01)

(52) U.S. Cl.
CPC ..... *B41J 2/175* (2013.01); *B41J 2/14* (2013.01); *B41J 2/14233* (2013.01); *B41J 2002/14419* (2013.01); *B41J 2002/14491* (2013.01); *B41J 2202/12* (2013.01); *B41J 2202/19* (2013.01); *B41J 2202/20* (2013.01)

(58) Field of Classification Search
CPC . B41J 2/045; B41J 2/04541; B41J 2/14; B41J 2/14233; B41J 2/175; B41J 2202/12; B41J 2202/19; B41J 2202/20; B41J 2202/14419; B41J 2202/14491
See application file for complete search history.

(56) References Cited

U.S. PATENT DOCUMENTS

| | | | | |
|---|---|---|---|---|
| 10,214,009 | B2 * | 2/2019 | McMullen | B41J 2/14233 |
| 2013/0208059 | A1 * | 8/2013 | Arimoto | B41J 2/14233 347/85 |

FOREIGN PATENT DOCUMENTS

| | | | |
|---|---|---|---|
| JP | 2002-527272 | A | 8/2002 |
| WO | 00/23279 | A1 | 4/2000 |
| WO | 2016/193749 | A1 | 12/2016 |

* cited by examiner

*Primary Examiner* — Anh T Vo
(74) *Attorney, Agent, or Firm* — Merchant & Gould P.C.

(57) ABSTRACT

A liquid discharge head includes: a first channel member including a liquid channel. The liquid channel includes: pressure chambers connected respectively to nozzles and arranged in a first direction; throttle channels connected to the pressure chambers and extending from connection portions with the pressure chambers toward a first side in a second direction orthogonal to the first direction; and coupling channels arranged in the first direction, each of the coupling channels being connected to two or more of the throttle channels that are adjacent to each other in the first direction, extending in a third direction orthogonal to the first direction and the second direction, having openings in a surface in the third direction of the first channel member.

18 Claims, 14 Drawing Sheets

LIQUID DISCHARGE HEAD

CROSS REFERENCE TO RELATED APPLICATION

The present application claims priority from Japanese Patent Application No. 2018-169430 filed on Sep. 11, 2018, the disclosure of which is incorporated herein by reference in its entirety.

BACKGROUND OF THE INVENTION

Field of the Invention

The present disclosure relates to a liquid discharge head configured to discharge liquid from nozzles.

Description of the Related Art

As an exemplary liquid discharge head configured to discharge liquid from nozzles, there is publicly known an ink-jet print head configured to discharge ink from nozzles. In a publicly known ink-jet print head, multiple chambers respectively connected to nozzles are arranged in a L direction and both ends in a W direction, which is orthogonal to the L direction, of each of the chambers are connected to channels extending in the W direction. Individual supply channels, which extend in an up-down direction orthogonal to the L direction and the W direction, are connected to ends, of the respective channels positioned at a first side in the W direction, opposite to the chambers. An upper surface of the ink-jet print head has openings that are arranged in the L direction and correspond to upper ends of the respective supply channels. Individual return channels, which extend in a direction orthogonal to the L direction and the W direction, are connected to ends, of the respective channels positioned at a second side in the width direction, opposite to the chambers. The return channels are arranged in the L direction. The upper surface of the ink-jet print head has openings that are arranged in the L direction and correspond to upper ends of the respective return channels.

SUMMARY

The upper surface of the above ink-jet print head is joined to a member formed having channels connected to the supply channels and the return channels. In a field of the ink-jet print head, arranging nozzles at high density has been recently required to speed up printing and achieve high resolution. In that configuration, the supply channels and the return channels are also arranged at high density.

When the supply channels and return channels are arranged at high density, multiple openings of the supply channels and multiple openings of the return channels are provided in the upper surface of the ink-jet print head. The positioning between the ink-jet print head and the member thus necessitates high precision. A low tolerance for the positioning between the ink-jet print head and the member may cause connection failure between the channels in the ink-jet print head and the channels in the member, which makes it impossible to flow ink therebetween.

An object of the present disclosure is to provide a liquid discharge head that includes nozzles arranged at high density and that is capable of reliably connecting channels formed in mutually different members when the members are joined with each other.

According to an aspect of the present disclosure, there is provided a liquid discharge head including a first channel member that includes a liquid channel, wherein the liquid channel includes:

- a plurality of pressure chambers connected respectively to a plurality of nozzles and arranged in a first direction;
- a plurality of throttle channels connected to the pressure chambers and extending from connection portions with the pressure chambers toward a first side in a second direction, which is orthogonal to the first direction; and
- a plurality of coupling channels arranged in the first direction, each of the coupling channels being connected to two or more of the throttle channels that are adjacent to each other in the first direction, extending in a third direction orthogonal to the first direction and the second direction, having a plurality of openings in a surface in the third direction of the first channel member.

DESCRIPTION OF THE EMBODIMENTS

Embodiments of the present disclosure are explained below.

<Schematic Configuration of Printer 1>

Figure 1:
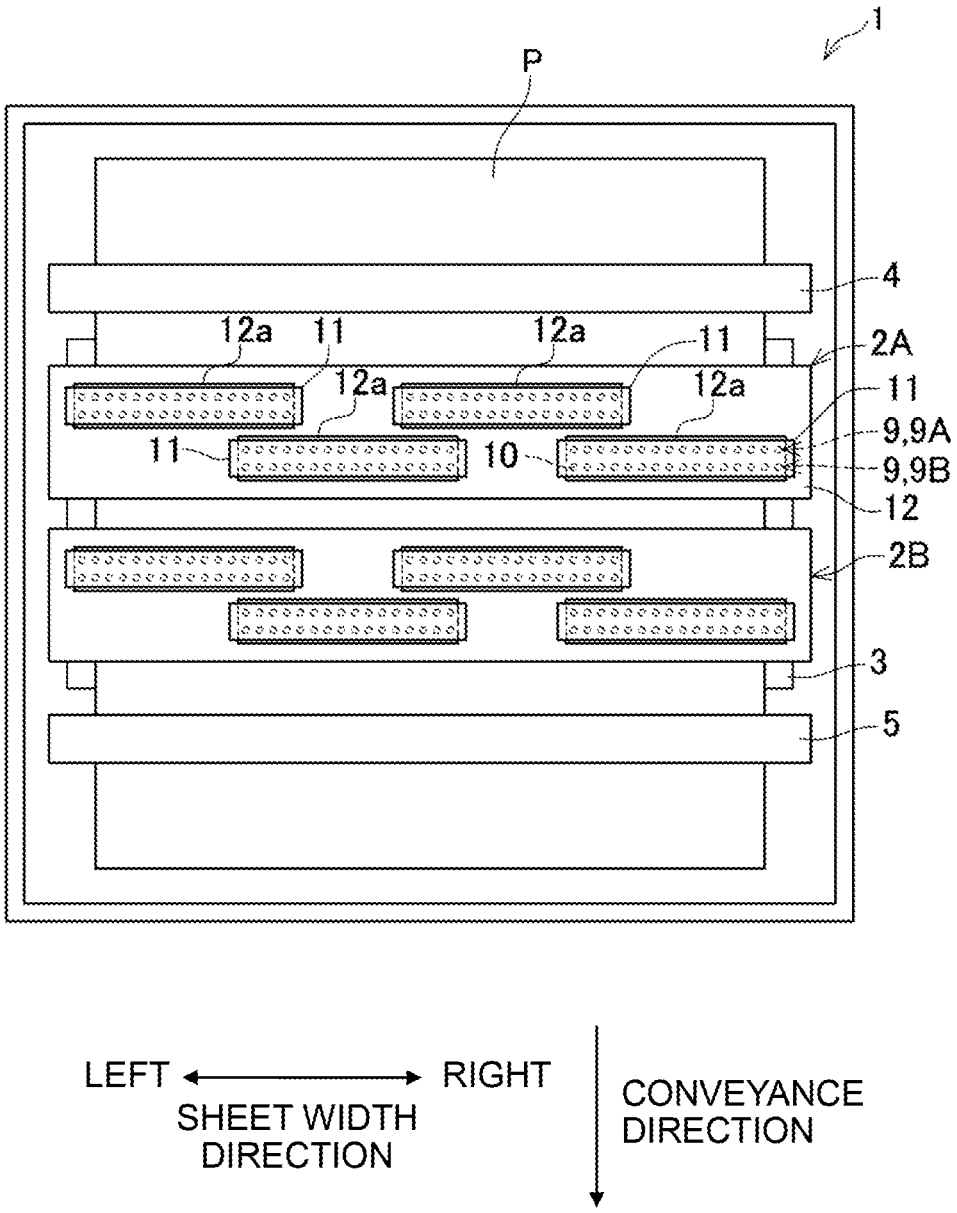
FIG. 1 depicts a schematic configuration of a printer 1 according to an embodiment.

As depicted in FIG. 1, a printer 1 according to this embodiment includes two ink-jet heads 2A and 2B, a platen 3, and conveyance rollers 4 and 5. The ink-jet head 2A and the ink-jet head 2B are arranged in a conveyance direction (a second direction of the present disclosure) in which a recording sheet P is conveyed. The ink-jet head 2B is disposed at the downstream side in the conveyance direction of the ink-jet head 2A. Each of the ink-jet heads 2A and 2B includes four head units 11 and a holding member 12.

Figure 3:
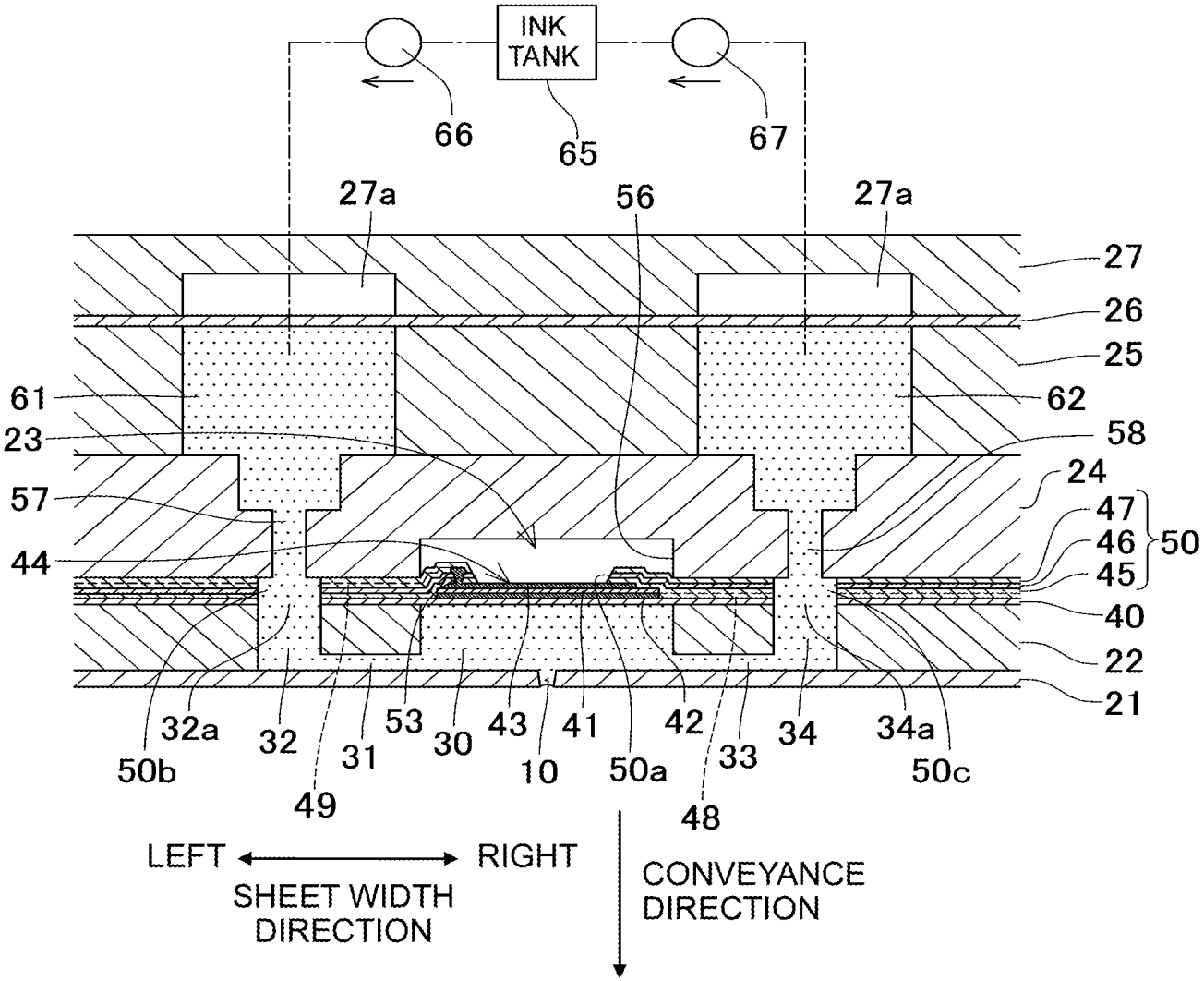
FIG. 3 is a cross-sectional view along a line in FIG. 2.

A lower surface of each head unit 11 is provided with nozzles 10. The nozzles 10 are aligned in a sheet width direction (a first direction of the present disclosure), which is orthogonal to the conveyance direction, to form a nozzle row 9. The head unit 11 includes two nozzle rows 9 arranged in the conveyance direction. The position in the sheet width direction of each nozzle 10 belonging to one of the two nozzle rows 9 is the same as that belonging to the other. In the following explanation, the right and the left in the sheet width direction are defined as indicated in FIG. 1 and an up-down direction of the printer 1 is defined as indicated in FIG. 3.

In the ink-jet head 2A, black ink is discharged from nozzles 10 forming a nozzle row 9 included in the two nozzle rows 9 and positioned at the upstream side in the conveyance direction (hereinafter referred to as a nozzle row 9A in some cases), and yellow ink is discharged from nozzles 10 forming a nozzle row 9 included in the two nozzle rows 9 and positioned at the downstream side in the conveyance direction (hereinafter referred to as a nozzle row 9B in some cases). In the ink-jet head 2B, cyan ink is discharged from nozzles 10 forming the nozzle row 9A positioned at the upstream side in the conveyance direction, and magenta ink is discharged from nozzles 10 forming the nozzle row 9B positioned at the downstream side in the conveyance direction.

In each of the ink-jet heads 2A and 2B, two of the four head units 11 are arranged in the sheet width direction at an interval. As depicted in FIG. 1, two head units 11 arranged in the sheet width direction and positioned at the upstream side in the conveyance direction and two head units 11 arranged in the sheet width direction and positioned at the downstream side in the conveyance direction are arranged in the conveyance direction at an interval. The positions in the sheet width direction of the two head units 11 disposed at the upstream side in the conveyance direction are different from those of the two head units 11 disposed at the downstream side in the conveyance direction. In that configuration, the nozzles 10 of the four head units 11 are arranged to cover the entire length in the sheet width direction of the recording sheet P. Part of the nozzles 10 included in the head unit 11 disposed at the upstream side in the conveyance direction and disposed at a first side in the sheet width direction overlap in the conveyance direction with part of the nozzles 10 included in the head unit 11 disposed at the downstream side in the conveyance direction and disposed at a second side in the sheet width direction. Namely, each of the ink-jet heads 2A and 2B is a line head that extends to cover the entire length in the sheet width direction of the recording sheet P.

The holding member 12 is a rectangular plate-like member that extends to cover the entire length in the sheet width direction of the recording sheet P. The holding member 12 has four through holes 12*a*, which respectively correspond to the four head units 11. The nozzles 10 of each head unit 11 are exposed to a lower side in the up-down direction (recording sheet P side) via the corresponding one of the through holes 12*a*.

The platen 3, which is disposed below the ink-jet heads 2A and 2B, faces the nozzles 10 of the ink-jet heads 2A and 2B. The platen 3 supports the recording sheet P from below.

The conveyance roller 4 is disposed upstream of the ink-jet heads 2A, 2B and the platen 3 in the conveyance direction. The conveyance roller 5 is disposed downstream of the ink-jet heads 2A, 2B and the platen 3 in the conveyance direction. The conveyance rollers 4 and 5 convey the recording sheet P in the conveyance direction.

The printer 1 performs recording on the recording sheet P by causing the ink-jet heads 2A and 2B to discharge ink(s) from the nozzles 10 to the recording sheet P while conveying the recording sheet P in the conveyance direction by use of the conveyance rollers 4 and 5.

<Head Units 11>

Figure 2:
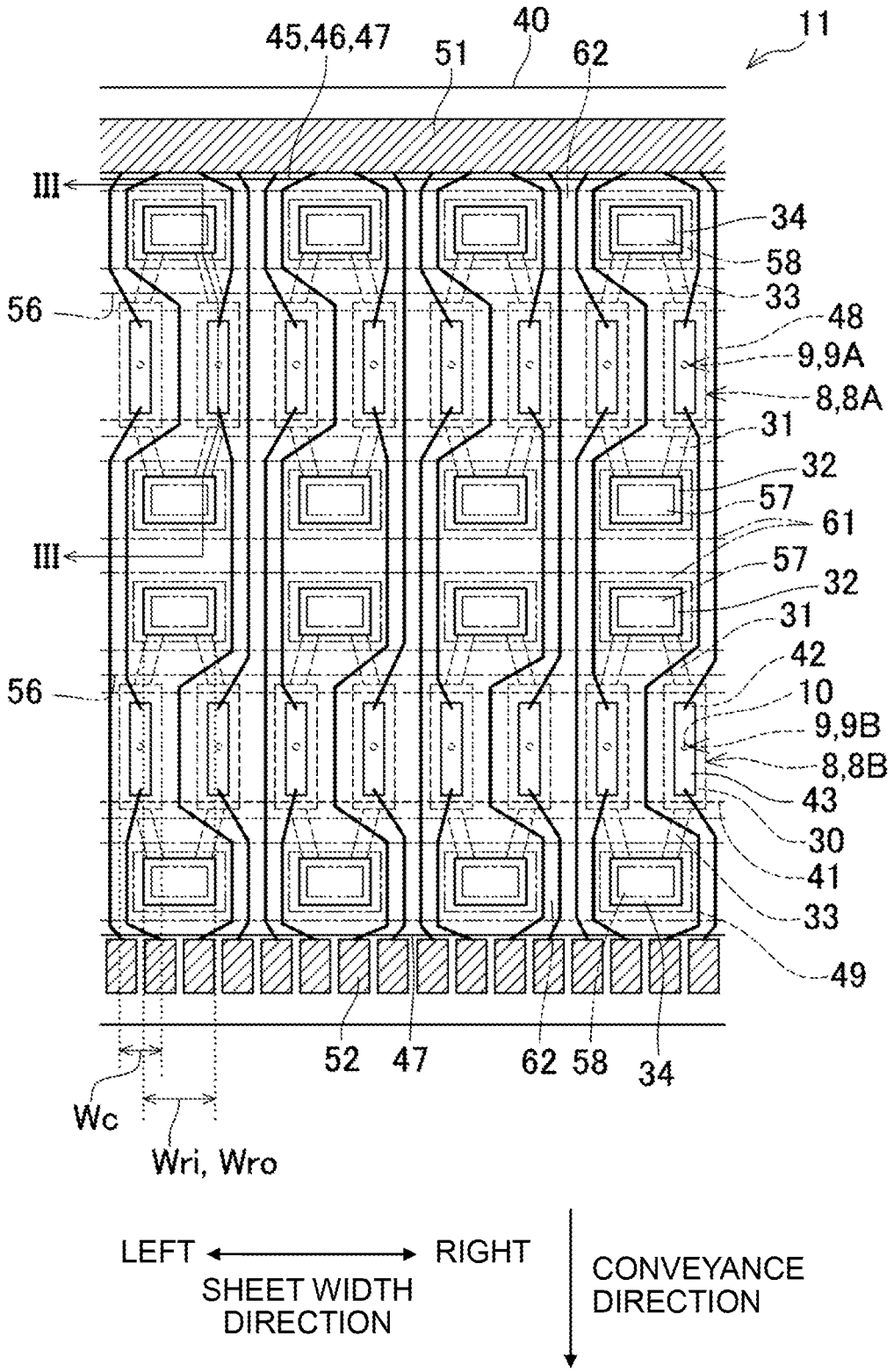
FIG. 2 is a plan view depicting part of a head unit 11 in FIG. 1.

The head units 11 are explained below. As depicted in FIGS. 2 to 5, each head unit 11 includes a nozzle plate 21, a channel substrate 22 (a first channel member of the present disclosure), a piezoelectric actuator 23, a protection substrate 24 (a second channel member of the present disclosure), and a manifold member 25. In FIG. 2, traces 48 and 49, which are covered with protection films 45 to 47 described below and should be indicated by broken lines, are indicated by solid lines to clearly show the positions of traces. The same is true of FIGS. 7, 8, and 12 described below.

The nozzle plate 21 is made using a synthetic resin material, such as polyimide. The nozzle plate 21 includes nozzles 10 forming the two nozzle rows 9, as described above.

The channel substrate 22, which is made using silicon (Si), is disposed on an upper surface of the nozzle plate 21. The channel substrate 22 includes pressure chambers 30, inflow throttle channels 31, inflow coupling channels 32, outflow throttle channels 33, and outflow coupling channels 34.

The pressure chambers 30 are provided corresponding to the respective nozzles 10. Each pressure chamber 30 is a rectangle of which longitudinal direction is the conveyance direction as viewed in the up-down direction. A center portion of each pressure chamber 30 overlaps in the up-down direction with the corresponding nozzle 10. In that configuration, the pressure chambers 30 are aligned in the sheet width direction to form a pressure chamber row 8, and the channel substrate 22 includes two pressure chamber rows 8 that are arranged in the conveyance direction to correspond to the two nozzle rows 9. In the following, the pressure chamber row 8 that is disposed at the upstream side in the conveyance direction and corresponds to the nozzle row 9A may be referred to as a pressure chamber row 8A, and the pressure chamber row 8 that is disposed at the downstream side in the conveyance direction and corresponds to the nozzle row 9B may be referred to as a pressure chamber row 8B.

Each of the inflow throttle channels 31 is formed corresponding to one of the pressure chambers 30. The inflow throttle channel 31 is connected to a lower end of the corresponding pressure chamber 30 positioned at the inflow coupling channel 32 side in the conveyance direction of the head unit 11. Each inflow throttle channel 31 extends inward in the conveyance direction of the head unit 11 (a first side in the second direction of the present disclosure) from the connection portion with the pressure chamber 30.

Each of the inflow coupling channels 32 is provided for two inflow throttle channels 31 arranged adjacently to each other in the sheet width direction. The inflow coupling channel 32 is connected to ends, of the corresponding two inflow throttle channels 31, opposite to the pressure chambers 30. The inflow coupling channel 32 extends in the up-down direction (a third direction of the present disclosure) and an upper surface of the channel substrate 22 has openings 32*a*. A length Wri in the sheet width direction of the inflow coupling channel 32 is longer than a length Wc in the sheet width direction of the pressure chamber 30 and shorter than a length 2×Wc that is twice as long as the length Wc of the pressure chamber 30 (Wc<Wri<2×Wc). Corresponding to this, the inflow throttle channel 31 extends in the conveyance direction while being inclined thereto so that the inflow throttle channel 31 extends inward in the sheet width direction of the inflow coupling channel 32 as the inflow throttle channel 31 approaches the inflow coupling channel 32 in the sheet width direction. For example, the length Wc is approximately 55 μm and the length Wri is approximately 80 μm.

Each of the outflow throttle channels 33 is formed corresponding to one of the pressure chambers 30. The outflow throttle channel 33 is connected to a lower end of the corresponding pressure chamber 30 at the outflow coupling channel 34 side in the conveyance direction of the head unit 11. Each outflow throttle channel 33 extends outward in the conveyance direction of the head unit 11 (a second side in the second direction of the present disclosure) from the connection portion with the pressure chamber 30.

Each of the outflow coupling channels 34 is provided for two outflow throttle channels 33 arranged adjacently to each other in the sheet width direction. The outflow coupling channel 34 is connected to ends, of the corresponding two outflow throttle channels 33, opposite to the pressure chambers 30. The outflow coupling channel 34 extends in the up-down direction and the upper surface of the channel substrate 22 has openings 34*a*. A length Wro in the sheet width direction of the outflow coupling channel 34 is longer than the length Wc in the sheet width direction of the pressure chamber 30 and shorter than the length 2×Wc that is twice as long as the length Wc of the pressure chamber 30 (Wc<Wro<2×Wc). In this embodiment, the length Wri in the sheet width direction of the inflow coupling channel 32 is substantially the same as the length Wro in the sheet width direction of the outflow coupling channel 34. The outflow throttle channel 33 extends in the conveyance direction while being inclined thereto so that the outflow throttle channel 33 extends inward in the sheet width direction of the outflow coupling channel 34 as the outflow throttle channel 33 approaches the outflow coupling channel 34 in the sheet width direction.

<Piezoelectric Actuator 23>

The piezoelectric actuator 23 includes a vibration film 40, two piezoelectric films 41 (a piezoelectric body of the present disclosure), lower electrodes 42 (a first electrode of the present disclosure), and upper electrodes 43 (a second electrode of the present disclosure).

The vibration film 40 is made using silicon dioxide (SiO2), silicon nitride (SiN), or the like. The vibration film 40 is formed by oxygenating or nitriding an upper end of the channel substrate 22. The vibration film 40 covers the pressure chambers 30.

The piezoelectric films 41 are made using a piezoelectric material that includes lead zirconate titanate as a main component. The lead zirconate titanate is a mixed crystal of lead titanate and lead zirconate. The piezoelectric films 41 are disposed on an upper surface of the vibration film 40. The two piezoelectric films 41 correspond to the two pressure chamber rows 8, and extend in the sheet width direction to cover the pressure chambers 30 forming the respective pressure chamber rows 8.

The lower electrodes 42 are made, for example, using platinum (Pt). Each of the lower electrodes 42 is formed corresponding to one of the pressure chambers 30. The lower electrode 42 is a rectangle that is smaller to some extent than the pressure chamber 30 as viewed in the up-down direction. Each lower electrode 42 is disposed between the vibration film 40 and the piezoelectric film 41 to overlap in the up-down direction with the center portion of the corresponding pressure chamber 30. The lower electrodes 42 are kept at the ground potential. In this embodiment, a lower surface of each piezoelectric film 41 corresponds to a first surface in the third direction of the piezoelectric body of the present disclosure.

The upper electrodes 43 are made, for example, using platinum (Pt) or iridium (Ir). Each of the upper electrodes 43 is formed corresponding to one of the pressure chambers 30. The upper electrode 43 is a rectangle that is smaller to some extent than the pressure chamber 30 as viewed in the up-down direction. Each upper electrode 43 is disposed on an upper surface of the piezoelectric film 41 to overlap in the up-down direction with the center portion of the corresponding pressure chamber 30. Any of the ground potential and predefined driving potential is selectively applied to each upper electrode 43. In this embodiment, the upper surface of each piezoelectric film 41 corresponds to a second surface in the third direction of the piezoelectric body of the present disclosure.

Portions included in the piezoelectric actuator 23 and overlapping in the up-down direction with the pressure chambers 30 are driving elements 44. Each driving element 44 applies pressure to ink in the corresponding pressure chamber 30.

Here, the method of driving each driving element 44 to apply pressure to ink in the corresponding pressure chamber 30 and discharging ink from the corresponding nozzle 10 is explained. In the piezoelectric actuator 23, the upper electrodes 43 of all the driving elements 44 are kept at the ground potential. In order to discharge ink from a certain nozzle 10, the potential of the upper electrode 43 of the driving element 44 corresponding to the certain nozzle 10 is switched to the driving potential. This causes the difference in potential between the lower electrode 42 and the upper electrode 43, generating an electric field in a thickness direction at part of the piezoelectric film 41 interposed between the lower electrode 42 and the upper electrode 43. The part of the piezoelectric film 41 contracts in a horizontal direction orthogonal to the direction of the electric field. In that situation, the piezoelectric film 41 and the vibration film 40 are deformed to be convex toward the pressure chamber 30 side, thus making the volume of the pressure chamber 30 small. The pressure of ink in the pressure chamber 30 is thus increased, which discharges ink from the nozzle 10 communicating with the pressure chamber 30. After discharge of ink, the potential of the upper electrode 43 returns to the ground potential.

The piezoelectric actuator 23 includes the protection films 45 to 47, the lower traces 48 (a first trace of the present disclosure), and the upper traces 49 (a second trace of the present disclosure). The protection films 45 to 47 are stacked on top of each other in that order from the bottom to cover the piezoelectric actuator 23. The protection film 45 is made, for example, using alumina (Al2O3). The protection film 46 is made, for example, using silicon dioxide (SiO2). The protection film 47 is made, for example, using silicon nitride (SiNx).

A stacked body 50, which is formed by the protection films 45 to 47, has through holes 50*a*. Each through hole 50*a* is provided at part of the piezoelectric actuator 23 overlapping in the up-down direction with the center portion of each pressure chamber 30. In that configuration, the protection films 45 to 47 are not likely to inhibit the deformation of the vibration film 40 and the piezoelectric film 41 at the time of driving each driving element 44. Further, the stacked body 50 has through holes 50*b* and through holes 50*c*. Each through hole 50*b* is provided at part of the stacked body 50 overlapping in the up-down direction with each inflow coupling channel 32. Each through hole 50*c* is provided at part of the stacked body 50 overlapping in the up-down direction with each outflow coupling channel 34.

Figure 4:
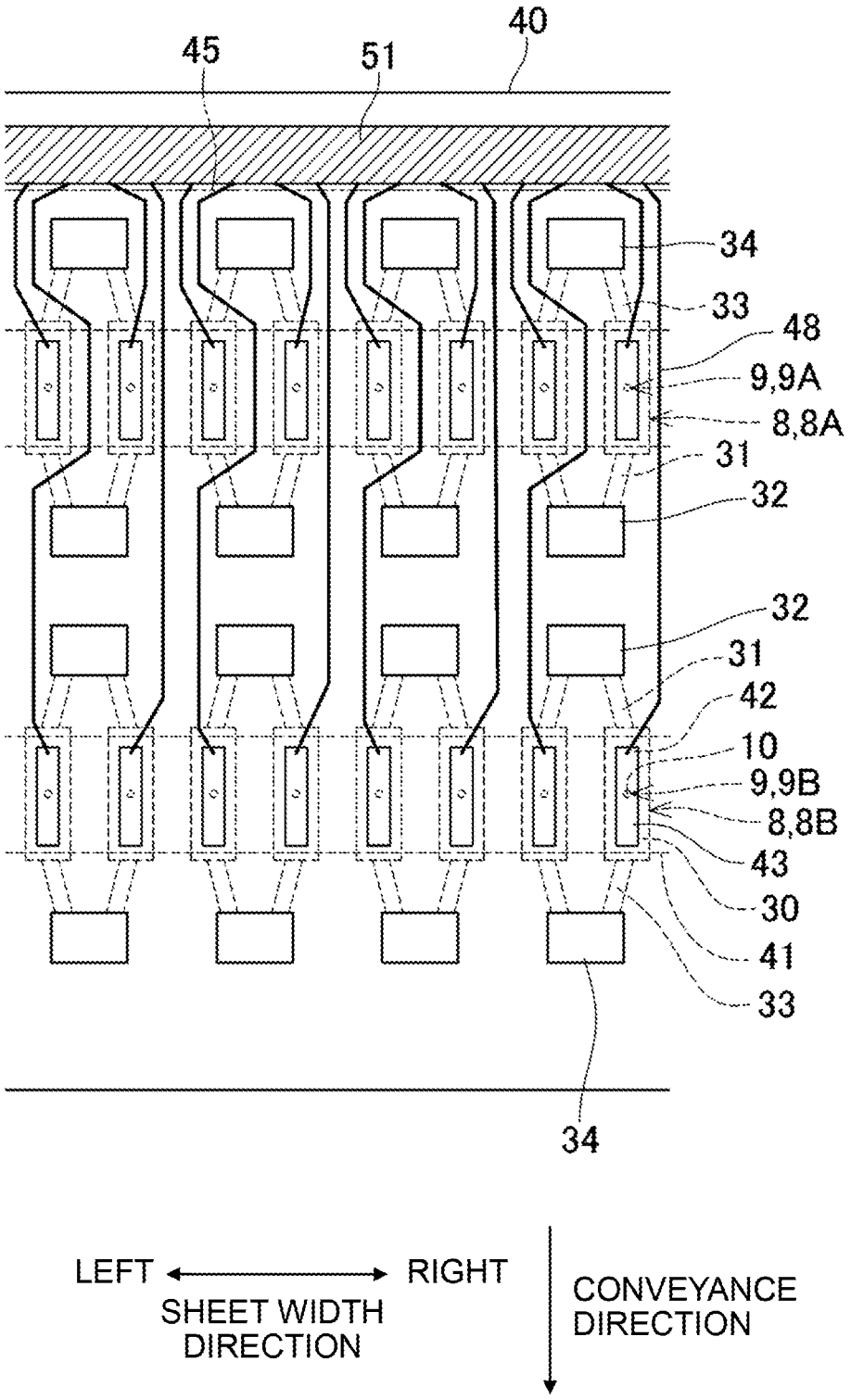
FIG. 4 depicts arrangement of lower traces 48 on an upper surface of a vibration film 40.

As depicted in FIGS. 2 to 4, the lower traces 48 are made, for example, using aluminium (Al), gold (Au), or the like. The lower traces 48 are disposed between the vibration film 40 and the protection film 45. Each of the lower traces 48 is formed corresponding to one of the lower electrodes 42. The lower trace 48 is connected to an end at the upstream side in the conveyance direction of the corresponding lower electrode 42. Each lower trace 48 extends upstream in the conveyance direction from the connection portion with the lower electrode 42.

More specifically, the lower traces 48 corresponding to the pressure chamber row 8A disposed at the upstream side in the conveyance direction extend through areas, of a surface between the vibration film 40 and the protection film 45, between the inflow coupling channels 32 arranged adjacently to each other in the sheet width direction and corresponding to the pressure chamber row 8A.

The lower traces 48 corresponding to the nozzle row 9B disposed at the downstream side in the conveyance direction extend through areas of, the surface between the vibration film 40 and the protection film 45, between the inflow coupling channels 32 arranged adjacently to each other in the sheet width direction and corresponding to the pressure chamber row 8B; areas of, the surface between the vibration film 40 and the protection film 45, between the inflow coupling channels 32 arranged adjacently to each other in the sheet width direction and corresponding to the pressure chamber row 8A; areas of, the surface between the vibration film 40 and the protection film 45, between the pressure chambers 30 arranged adjacently to each other in the sheet width direction and corresponding to the pressure chamber row 8A; and areas of, the surface between the vibration film 40 and the protection film 45, between the outflow coupling channels 34 arranged adjacently to each other in the sheet width direction and corresponding to the pressure chamber row 8A.

The spaced interval between the pressure chambers 30 in the sheet width direction is smaller than the spaced interval between the inflow coupling channels 32 in the sheet width direction and the spaced interval between the outflow coupling channels 34 in the sheet width direction. Thus, in this embodiment, only one lower trace 48 extends through the area between the pressure chambers 30 arranged adjacently to each other in the sheet width direction.

An end of each lower trace 48 opposite to the connection portion with the lower electrode 42 is connected to a common terminal 51 disposed upstream, in the conveyance direction, of the outflow coupling channels 34 corresponding to the pressure chamber row 8A. The common terminal 51 is connected to a power source via a trace member (not depicted), and is kept at the ground potential.

Figure 5:
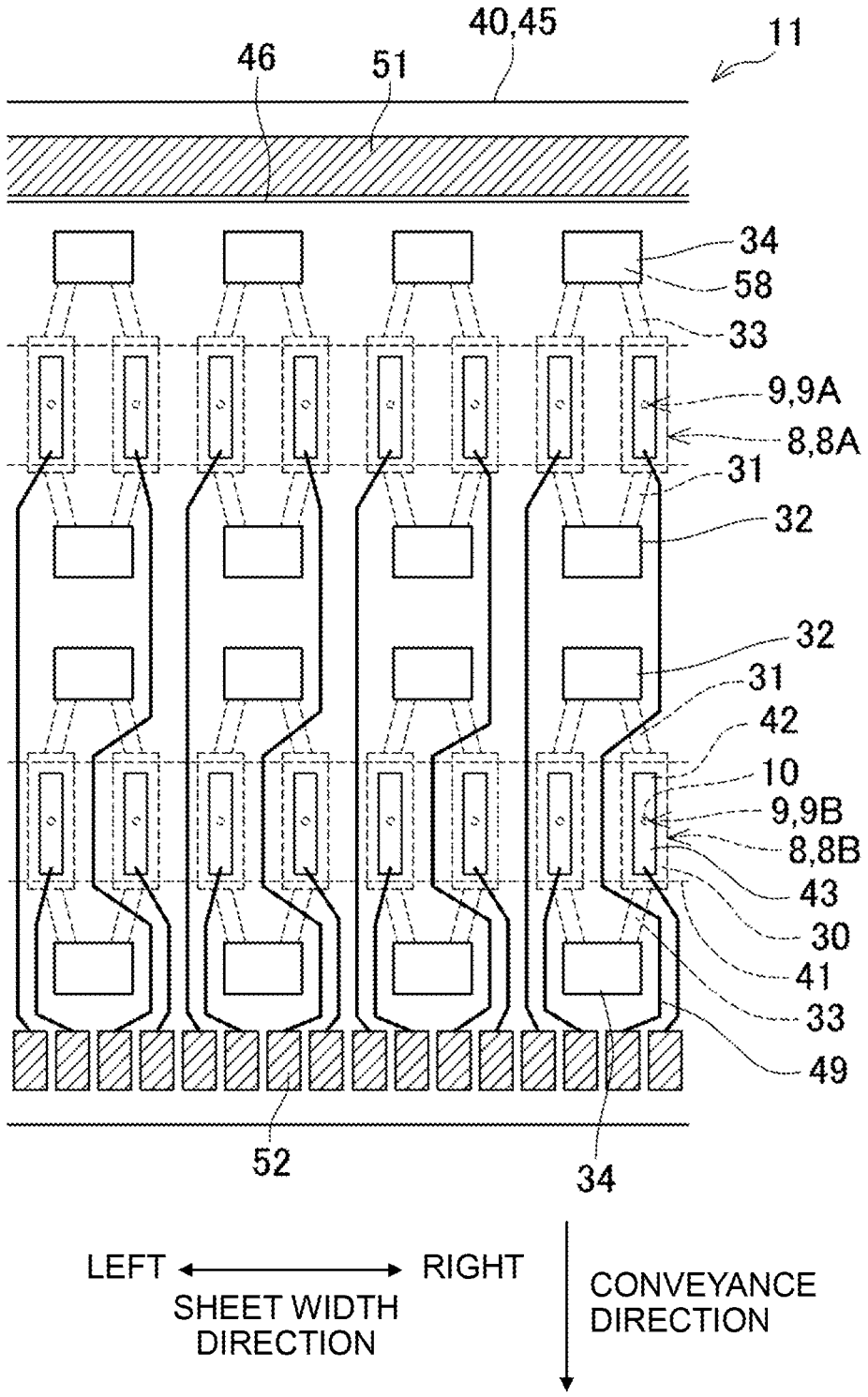
FIG. 5 depicts arrangement of upper traces 49 on an upper surface of a protection film 46.

As depicted in FIGS. 2, 3, and 5, the upper traces 49 are made, for example, using alumina (Al2O3), gold (Au), or the like. The upper traces 49 are disposed between the protection film 46 and the protection film 47. Each of the upper traces 49 is formed corresponding to one of the upper electrodes 43. The upper trace 49 is connected to an end at the downstream side in the conveyance direction of the corresponding upper electrode 43 via a conductive hole 53 formed in the protection films 45 and 46. Each upper trace 49 extends downstream in the conveyance direction from the connection portion with the upper electrode 43.

More specifically, the upper traces 49 corresponding to the pressure chamber row 8A extend through areas, of a surface between the protection film 46 and the protection film 47, between the inflow coupling channels 32 arranged adjacently to each other in the sheet width direction and corresponding to the pressure chamber row 8A; areas, of the surface between the protection film 46 and the protection film 47, between the inflow coupling channels 32 arranged adjacently to each other in the sheet width direction and corresponding to the pressure chamber row 8B; areas, of the surface between the protection film 46 and the protection film 47, between the pressure chambers 30 arranged adjacently to each other in the sheet width direction and corresponding to the pressure chamber row 8B; and areas, of the surface between the protection film 46 and the protection film 47, between the outflow coupling channels 34 arranged adjacently to each other in the sheet width direction and corresponding to the pressure chamber row 8B.

The upper traces 49 corresponding to the pressure chamber row 8B extend through areas, of the surface between the protection film 46 and the protection film 47, between the outflow coupling channels 34 arranged adjacently to each other in the sheet width direction and corresponding to the pressure chamber row 8B.

The spaced interval between the pressure chambers 30 in the sheet width direction is smaller than the spaced interval between the inflow coupling channels 32 in the sheet width direction and the spaced interval between the outflow coupling channels 34 in the sheet width direction. Thus, in this embodiment, only one upper trace 49 extends through the area between the pressure chambers 30 adjacent to each other in the sheet width direction.

An end of each upper trace 49 opposite to the connection portion with the upper electrode 43 is connected to each individual terminal 52 disposed downstream, in the conveyance direction, of the outflow coupling channels 34 corresponding to the pressure chamber row 8B. Each of the individual terminals 52 is formed corresponding to one of the upper traces 49. The individual terminals 52 are connected to a control circuit (not depicted), and any of the ground potential and the driving potential is selectively applied from the control circuit to the individual terminals 52.

<Protection Substrate 24>

As depicted in FIG. 3, the protection substrate 24 is joined, with adhesive, to the upper surface of the channel substrate 22 provided with the piezoelectric actuator 23. A lower surface of the protection substrate 24 includes two recesses 56. The two recesses 56 correspond to the two pressure chamber rows 8 to extend in the sheet width direction over the pressure chambers 30 forming the respective pressure chamber rows 8. A space between each recess 56 and the channel substrate 22 accommodates the driving elements 44 corresponding to the pressure chambers 30.

The protection substrate 24 includes inflow connecting channels 57 and outflow connecting channels 58.

Each of the inflow connecting channels 57 is formed corresponding to one of the inflow coupling channels 32. Each of the inflow connecting channels 57 passes through the protection substrate 24 in the up-down direction to overlap with the corresponding one of the inflow coupling channels 32 in the up-down direction. A lower portion of the inflow connecting channel 57 is shorter than an upper portion thereof in the sheet width direction and the conveyance direction. In that configuration, a lower portion of the inflow connecting channel 57 including the connection portion between the inflow coupling channel 32 and the opening 32*a* is positioned at the inside of the edge of the opening 32*a* as viewed in the up-down direction.

Each of the outflow connecting channels 58 is formed corresponding to one of the outflow coupling channels 34. Each of the outflow connecting channels 58 passes through the protection substrate 24 in the up-down direction to overlap with the corresponding one of the outflow coupling channels 34 in the up-down direction. A lower portion of the outflow connecting channel 58 is shorter than an upper portion thereof in the sheet width direction and the conveyance direction. In that configuration, a lower portion of the outflow connecting channel 58 including the connection portion between the outflow coupling channel 34 and the opening 34*a* is positioned at the inside of the edge of the opening 34*a* as viewed in the up-down direction.

<Manifold Member 25>

The manifold member 25 is disposed on an upper surface of the protection substrate 24. The manifold member 25 includes two inflow manifolds 61 and two outflow manifolds 62. In this embodiment, the inflow manifolds 61 and the outflow manifolds 62 correspond to a common channel of the present disclosure.

The two inflow manifolds 61 correspond to the two pressure chamber rows 8. Each inflow manifold 61 extends in the sheet width direction over the inflow connecting channels 57 that communicate with the pressure chambers 30 forming the corresponding pressure chamber row 8. Each inflow manifold 61 is connected to upper ends of the inflow connecting channels 57. The two outflow manifolds 62 correspond to the two pressure chamber rows 8. Each outflow manifold 62 extends in the sheet width direction over the outflow connecting channels 58 that communicate with the pressure chambers 30 forming the corresponding pressure chamber row 8. Each outflow manifold 62 is connected to upper ends of the outflow connecting channels 58.

The inflow manifolds 61 and the outflow manifolds 62 are connected to the same ink tank 65 via respective channels (not depicted). A supply pump 66 is provided in the channel between each inflow manifold 61 and the ink tank 65 to feed ink from the ink tank 65 to each inflow manifold 61. A discharge pump 67 is provided in the channel between each outflow manifold 62 and the ink tank 65 to feed ink from each outflow manifold 62 to the ink tank 65.

Driving the supply pump 66 and the discharge pump 67 allows ink in the ink tank 65 to flow into each inflow manifold 61 via the channel (not depicted), and then ink flows from each inflow manifold 61 to the pressure chambers 30 via the inflow connecting channels 57, the inflow coupling channels 32, and the inflow throttle channels 31. Further, ink in the pressure chambers 30 flows out to each outflow manifold 62 via the outflow throttle channels 33, the outflow coupling channels 34, and the outflow connecting channels 58, and then ink returns to the ink tank 65 from each outflow manifold 62 via the channel (not depicted). This causes ink to circulate between the ink tank 65 and each head unit 11. Although both the supply pump 66 and the discharge pump 67 are provided in this embodiment, only one of them may be provided. In that case, driving the pump allows ink to circulate similarly to the above.

A damper film 26 is disposed on an upper surface of the manifold member 25. The inflow manifolds 61 and the outflow manifolds 62 are covered with the damper film 26. Deformation of portions included in the damper film 26 and overlapping in the up-down direction with the inflow manifolds 61 and the outflow manifolds 62 inhibits the pressure change in ink in the inflow manifolds 61 and the outflow manifolds 62. A damper member 27 is disposed on an upper surface of the damper film 26. Damper chambers 27*a* are formed at portions included in a lower surface of the damper member 27 and overlapping in the up-down direction with the inflow manifolds 61 and the outflow manifolds 62.

<Effects>

Figure 6:
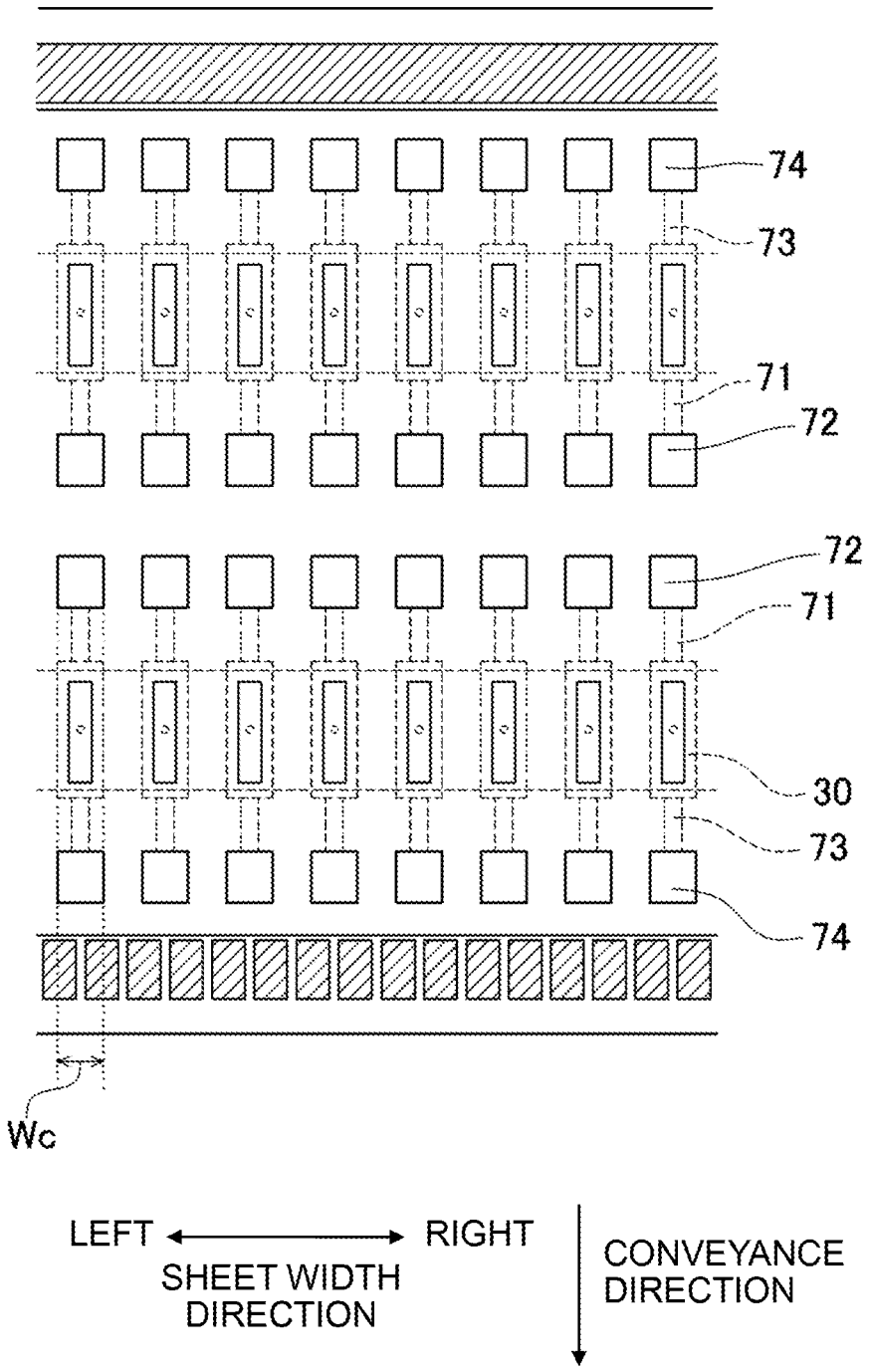
FIG. 6 depicts an example in which each pressure chamber 30 is provided with a inflow coupling channel 32 and a outflow coupling channel 34.

Unlike this embodiment, as depicted in FIG. 6, an inflow channel 72 and an outflow channel 74 may be provided for one of the pressure chambers 30, instead of the inflow coupling channel 32 and the outflow coupling channel 34. In that configuration, each of the inflow channels 72 extends in the up-down direction and is connected to the inflow throttle channel 71. Each of the outflow channels 74 extends in the up-down direction and is connected to the outflow throttle channel 73. Each of the inflow channels 72 and the outflow channels 74 has the same position in the sheet width direction as the corresponding one of the pressure chambers 30, and the inflow throttle channels 71 and the outflow throttle channels 73 extend parallel to the conveyance direction. The length in the sheet width direction of the inflow channels 72 and the outflow channels 74 is the length Wc, which is identical to the length in the sheet width direction of the pressure chambers 30. The length in the conveyance direction of the inflow channels 72 is identical to that of the inflow coupling channels 32, and the length in the conveyance direction of the outflow channels 74 is identical to that of the outflow coupling channels 34. In FIG. 6, illustration of traces, members disposed above the piezoelectric actuator 23, and the like are omitted.

In this embodiment, the inflow coupling channel 32 and the outflow coupling channel 34 are provided for two pressure chambers 30. Thus, when the channel substrate 22 is joined to the protection substrate 24 with adhesive, the accuracy of positioning required is lower than that of the case depicted in FIG. 6. This reliably connects the inflow coupling channels 32 and the inflow connecting channels 57 and connects the outflow coupling channels 34 and the outflow connecting channels 58.

In this embodiment, the length Wri in the sheet width direction of the inflow coupling channels 32 and the length Wro in the sheet width direction of the outflow coupling channels 34 are shorter than the length 2×Wc that is twice as long as the length Wc in the sheet width direction of the pressure chambers 30. When comparing this embodiment with the case depicted in FIG. 6, the length in the sheet width direction of the inflow coupling channel 32 corresponding to two pressure chambers 30 arranged adjacently to each other in the sheet width direction according to this embodiment is shorter than the total length in the sheet width direction of the two inflow channels 72*i* corresponding to two pressure chambers 30 depicted in FIG. 6. Similarly, the length in the sheet width direction of the outflow coupling channel 34 corresponding to two pressure chambers 30 arranged adjacently to each other in the sheet width direction according to this embodiment is shorter than the total length in the sheet width direction of the two outflow channels 74 corresponding to two pressure chambers 30 depicted in FIG. 6.

Thus, the area, of the channel substrate 22 formed having the piezoelectric actuator 23, joined to the protection substrate 24 according to this embodiment is larger than that of the case depicted in FIG. 6. The channel substrate 22 is thus reliably joined to the protection substrate 24 with adhesive in this embodiment. When multiple nozzles 10 are arranged in each head unit 11 at high density, the total area of the openings 32*a* of the inflow coupling channels 32 and the openings 34*a* of the outflow coupling channels 34 is large. In that configuration, making the area, of the channel substrate 22 formed having the piezoelectric actuator 23, joined to the protection substrate 24 large is very effective.

In this embodiment, the length Wri in the sheet width direction of the inflow coupling channels 32 and the length Wro in the sheet width direction of the outflow coupling channels 34 are longer than the length Wc in the sheet width direction of the pressure chambers 30. The volume of the inflow coupling channel 32 connected to two inflow throttle channels 31 and corresponding to two pressure chambers 30 is thus sufficient for the two inflow throttle channels 31. Similarly, the volume of the outflow coupling channel 34 connected to two outflow throttle channels 33 and corresponding to two pressure chambers 30 is sufficient for the two outflow throttle channels 33.

When the channel substrate 22 is joined to the protection substrate 24, if a positional shift between the inflow coupling channel 32 and the inflow connecting channel 57 is caused and the inflow connecting channel 57 is positioned outside the edge of the inflow coupling channel 32, the area where the inflow coupling channel 32 is connected to the inflow connecting channel 57 would be small. This make it impossible to flow ink between the inflow coupling channel 32 and the inflow connecting channel 57 sufficiently. Similarly, when the channel substrate 22 is joined to the protection substrate 24, if a positional shift between the outflow coupling channel 34 and the outflow connecting channel 58 is caused and the outflow connecting channel 58 is positioned outside the edge of the outflow coupling channel 34, the area where the outflow coupling channel 34 is connected to the outflow connecting channel 58 would be small. This may make it impossible to flow ink between the outflow coupling channel 34 and the outflow connecting channel 58 sufficiently. The above cases may cause an insufficiency of refilling with ink, variation in discharge amounts of ink between nozzles 10, and the like.

In this embodiment, the inflow connecting channel 57 is positioned at the inside of the edge of the inflow coupling channel 32 and the outflow connecting channel 58 is positioned at the inside of the edge of the outflow coupling channel 34, as viewed in the up-down direction. In that configuration, when the channel substrate 22 is joined to the protection substrate 24, if a small positional shift between the inflow coupling channel 32 and the inflow connecting channel 57 is caused, the inflow connecting channel 57 would not be positioned at the outside of the edge of the inflow coupling channel 32. Similarly, when the channel substrate 22 is joined to the protection substrate 24, if a small positional shift between the outflow coupling channel 34 and the outflow connecting channel 58 is caused, the outflow connecting channel 58 would not be positioned at the outside of the edge of the outflow coupling channel 34.

In the above configuration according to this embodiment, the area where the channel substrate 22 is joined to the protection substrate 24 is larger than that of a case in which part of the inflow connecting channel 57 is positioned outside the edge of the inflow coupling channel 32 as viewed in the up-down direction and that of a case in which part of the outflow connecting channel 58 is positioned outside the edge of the outflow coupling channel 34 as viewed in the up-down direction. The channel substrate 22 is thus reliably joined to the protection substrate 24 with adhesive.

In this embodiment, the length Wri in the sheet width direction of the inflow coupling channel 32 and the length Wro in the sheet width direction of the outflow coupling channel 34 are shorter than the length 2×Wc that is the total length in the sheet width direction of the corresponding two pressure chambers 30. Corresponding to this, the inflow throttle channel 31 and the outflow throttle channel 33 extend in the conveyance direction while being inclined thereto. This makes the length of the throttle channels shorter than that of a case, for example, in which the throttle channels extend while being bent in the middle thereof.

Unlike this embodiment, one inflow coupling channel 32 and one outflow coupling channel 34 may be provided for all the pressure chambers 30 corresponding to each of the nozzle rows 9. In that case, all the traces 48 and 49 are required to be arranged in areas at both sides in the sheet width direction of the one inflow coupling channel 32 and areas at both sides in the sheet width direction of the one outflow coupling channel 34. On the other hand, in this embodiment, the inflow coupling channels 32 each corresponding to two pressure chambers 30 are arranged in the sheet width direction at intervals, and the outflow coupling channels 34 each corresponding to two pressure chambers 30 are arranged in the sheet width direction at intervals. The traces 48 and 49 extend through multiple areas between the openings 32*a* of the adjacent inflow coupling channels 32 and multiple areas between the openings 34*a* of the adjacent outflow coupling channels 34. Since the traces 48 and 49 are arranged in mutually different areas, the traces 48 and 49 are arranged more easily than the case in which one inflow coupling channel 32 and one outflow coupling channel 34 are provided for all the pressure chambers 30 corresponding to each of the nozzle rows 9.

In this embodiment, each of the lower electrodes 42 is connected to one of the lower traces 48 and each of the upper electrodes 43 is connected to one of the upper traces 49, which makes the number of traces relatively large. Especially, when multiple nozzles 10 are arranged in each head unit 11 at high density, the number of traces is large. Thus, it is effective for this embodiment to adopt the arrangement in which the traces 48 and 49 extend through multiple areas between the openings 32*a* of the adjacent inflow coupling channels 32 and multiple areas between the openings 34*a* of the adjacent outflow coupling channels 34.

In this embodiment, the common terminal 51 is disposed at the upstream end in the conveyance direction of the head unit 11, and the individual terminals 52 are disposed at the downstream end in the conveyance direction of the head unit 11. In this embodiment, the upper traces 49 corresponding to the pressure chamber row 8A disposed at the upstream side in the conveyance direction extend through areas between the adjacent inflow coupling channels 32 that correspond to the pressure chamber row 8B disposed at the downstream side in the conveyance direction, areas between the adjacent pressure chambers 30 that correspond to the pressure chamber row 8B, and areas between the adjacent outflow coupling channels 34 that correspond to the pressure chamber row 8B, and the upper traces 49 are connected to the respective individual terminals 52. Further, the lower traces 48 corresponding to the pressure chamber row 8B disposed at the downstream side in the conveyance direction extend through areas between the adjacent inflow coupling channels 32 that correspond to the pressure chamber row 8A disposed at the upstream side in the conveyance direction, areas between the adjacent pressure chambers 30 that correspond to the pressure chamber row 8A, and areas between the adjacent outflow coupling channels 34 that correspond to the pressure chamber row 8A, and the lower traces 48 are connected to the common terminal 51.

In this embodiment, the spaced interval between the adjacent pressure chambers 30 is smaller than the spaced interval between the adjacent inflow coupling channels 32 and the spaced interval between the adjacent outflow coupling channels 34. Since the area between the adjacent pressure chambers 30 is small, one trace 48 and one trace 49 extend through the area between the adjacent pressure chambers 30. This inhibits a short circuit between traces.

In this embodiment, the lower traces 48 and the upper traces 49 are arranged on mutually different surfaces. This makes the spaced interval between traces larger than that of a case in which all the traces are arranged on the same surface.

Although the embodiment of the present disclosure is described above, the present disclosure is not limited thereto. The present disclosure may include various modifications without departing from the claims below.

In the above embodiment, the external form of the inflow coupling channels 32 and the outflow coupling channels 34 as viewed in the up-down direction is a rectangle in which all the corners have a right angle. The present disclosure, however, is not limited thereto.

Figure 7:
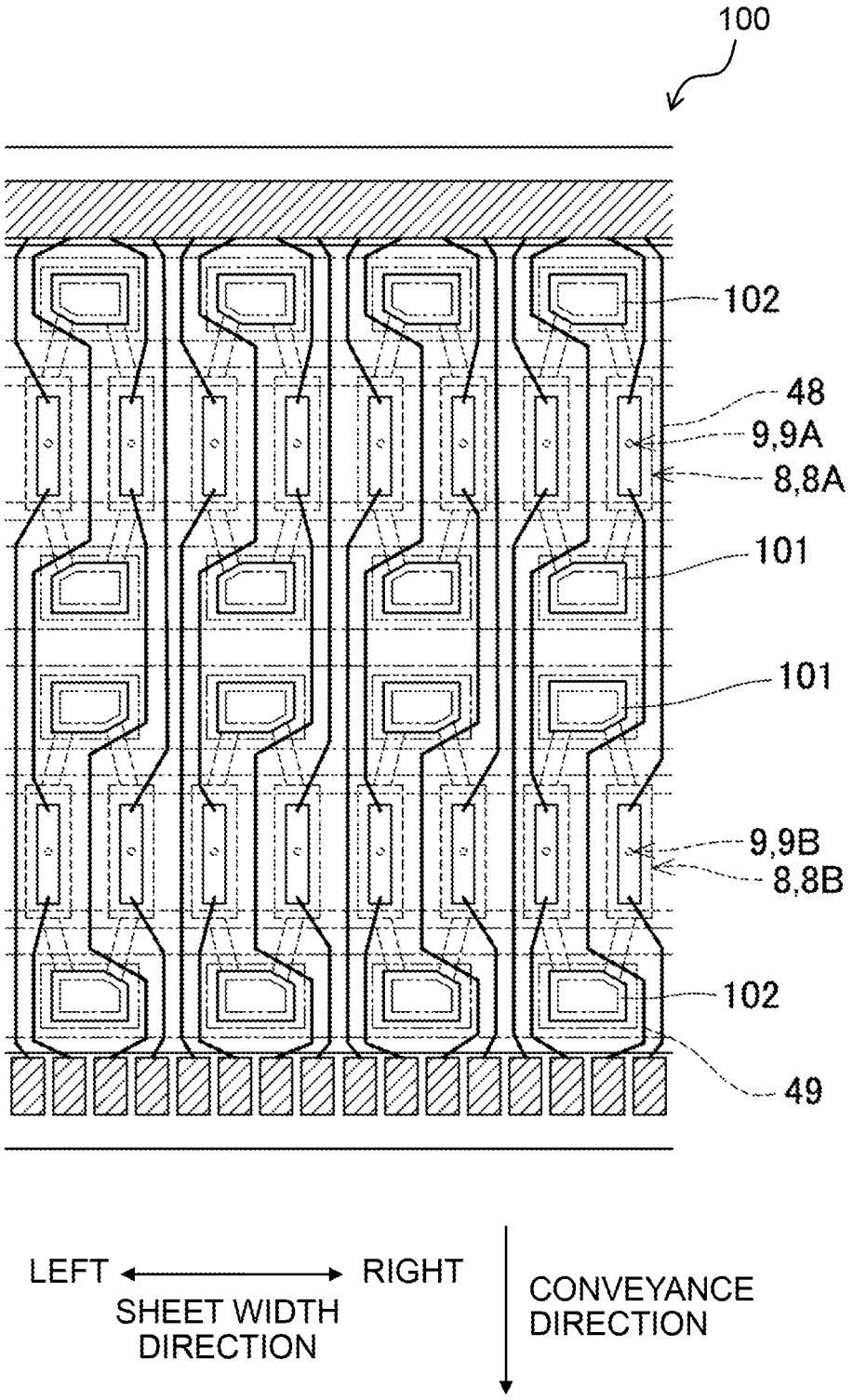
FIG. 7 is a plan view of a head unit 100 according to a first modified embodiment and FIG. 7 corresponds to FIG. 2.

In a head unit 100 according to a first modified embodiment, as depicted in FIG. 7, the external form of inflow coupling channels 101 corresponding to the nozzle row 9A as viewed in the up-down direction is a rectangle in which a corner at the left side in the sheet width direction and the upstream side in the conveyance direction is chamfered. The external form of outflow coupling channels 102 corresponding to the nozzle row 9A as viewed in the up-down direction is a rectangle in which a corner at the left side in the sheet width direction and the downstream side in the conveyance direction is chamfered. Further, the external form of the inflow coupling channels 101 corresponding to the nozzle row 9B as viewed in the up-down direction is a rectangle in which a corner at the right side in the sheet width direction and the downstream side in the conveyance direction is chamfered. The external form of the outflow coupling channels 102 corresponding to the nozzle row 9B as viewed in the up-down direction is a rectangle in which a corner at the right side in the sheet width direction and the upstream side in the conveyance direction is chamfered.

In the vicinities of the chamfered corners of the inflow coupling channels 101 and the outflow coupling channels 102, the traces 48 and 49 extend along the chamfered corners in a direction inclined to the sheet width direction and the conveyance direction.

When the traces 48 and 49 are arranged to extend between the adjacent inflow coupling channels 101 and between the adjacent outflow coupling channels 102, the traces 48 and 49 are arranged to extend around the inflow coupling channels 101 and the outflow coupling channels 102. In the first modified embodiment, the external forms of the inflow coupling channels 101 and the outflow coupling channels 102 as viewed in the up-down direction are the rectangles each having one chamfered corner. The inflow coupling channels 101 and the outflow coupling channels 102 are thus not likely to interfere with the drawing or routing of the traces 48 and 49.

In the vicinities of the chamfered corners of the inflow coupling channels 101 and the outflow coupling channels 102, the traces 48 and 49 are arranged to extend along the chamfered corners in directions inclined to the sheet width direction and the conveyance direction. This makes the lengths of the traces 48 and 49 as short as possible.

In the first modified embodiment, the external forms of the inflow coupling channels 101 and the outflow coupling channels 102 as viewed in the up-down direction are the rectangles each having one chamfered corner. Each of the external forms, however, may be a rectangle having two or more chamfered corners.

Figure 8:
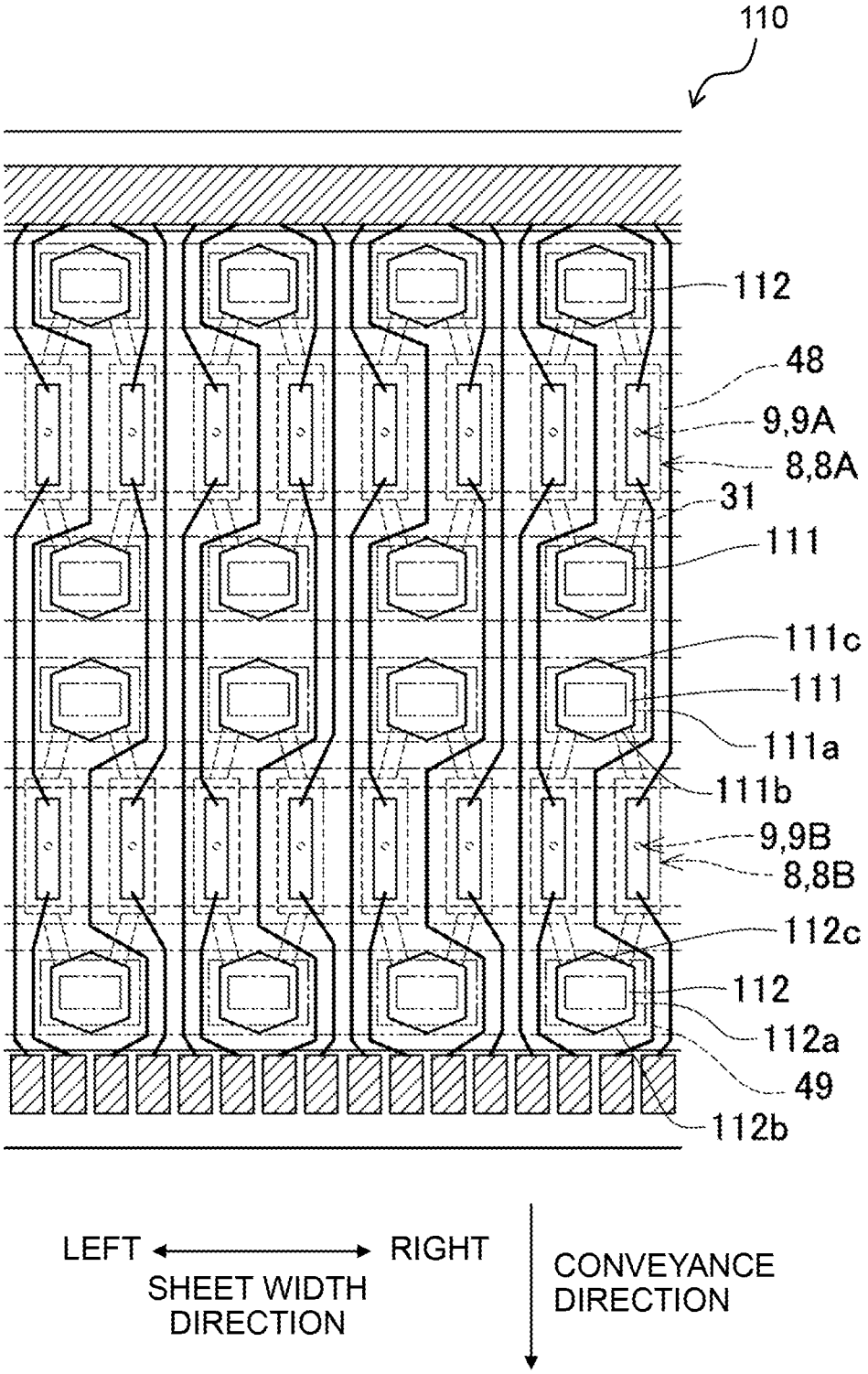
FIG. 8 is a plan view of a head unit 110 according to a second modified embodiment and FIG. 8 corresponds to FIG. 2.

In a head unit 110 according to a second modified embodiment, as depicted in FIG. 8, the external form of inflow coupling channels 111 as viewed in the up-down direction is a hexagon having: two sides 111*a* parallel to the conveyance direction; two sides 111*b* that are inclined to the sheet width direction and the conveyance direction so that the two sides 111*b* extend leftward in the sheet width direction as the two sides 111*b* extend downstream in the conveyance direction; and two sides 111*c* that are inclined to the sheet width direction and the conveyance direction so that the two sides 111*c* extend rightward in the sheet width direction as the two sides 111*c* extend downstream in the conveyance direction.

Further, the external form of outflow coupling channels 112 as viewed in the up-down direction is a hexagon having: two sides 112*a* parallel to the conveyance direction; two sides 112*b* that are inclined to the sheet width direction and the conveyance direction so that the two sides 112*b* extend leftward in the sheet width direction as the two sides 112*b* extend downstream in the conveyance direction; and two sides 112*c* that are inclined to the sheet width direction and the conveyance direction so that the two sides 112*c* extend rightward in the sheet width direction as the two sides 112*c* extend downstream in the conveyance direction.

In the vicinities of the sides 111*b*, 111*c*, 112*b*, and 112*c*, which are inclined to the sheet width direction and the conveyance direction, of the hexagons, the traces 48 and 49 extend along those sides while being inclined to the sheet width direction and the conveyance direction.

When the traces 48 and 49 are arranged to extend between the adjacent inflow coupling channels 111 and between the adjacent outflow coupling channels 112, the traces 48 and 49 are arranged to extend around the inflow coupling channels 111 and the outflow coupling channels 112. In the second modified embodiment, the external form of the inflow coupling channels 111 as viewed in the up-down direction is the hexagon having the sides 111*b* and 111*c* inclined to the sheet width direction and the conveyance direction and the external form of the outflow coupling channels 112 as viewed in the up-down direction is the hexagon having the sides 112*b* and 112*c* inclined to the sheet width direction and the conveyance direction. The inflow coupling channels 111 and the outflow coupling channels 112 are thus not likely to interfere with the drawing or routing of the traces 48 and 49.

In the vicinities of the sides 111*b*, 111*c*, 112*b*, and 112*c*, which are inclined to the sheet width direction and the conveyance direction, of the hexagons, the traces 48 and 49 are arranged to extend along those sides while being inclined to the sheet width direction and the conveyance direction. This makes the lengths of the traces 48 and 49 as short as possible.

In the second modified embodiment, the external form of the inflow coupling channel 111 and the outflow coupling channel 112 as viewed in the up-down direction is the hexagon. The external form, however, may be another polygon having sides inclined to the sheet width direction and the conveyance direction.

In each of the first and second modified embodiments, in the vicinities of portions included in the coupling channels and extending inclined to the sheet width direction and the conveyance direction, the traces extend along the inclined portions of the coupling channels. The present disclosure, however, is not limited thereto. For example, in the vicinities of the portions included in the coupling channels and extending inclined to the sheet width direction and the conveyance direction, for example, the traces may extend while being bent.

In the above embodiment, each of the lower traces 48 is connected to the common terminal 51. The present disclosure, however, is limited thereto.

Figure 9:
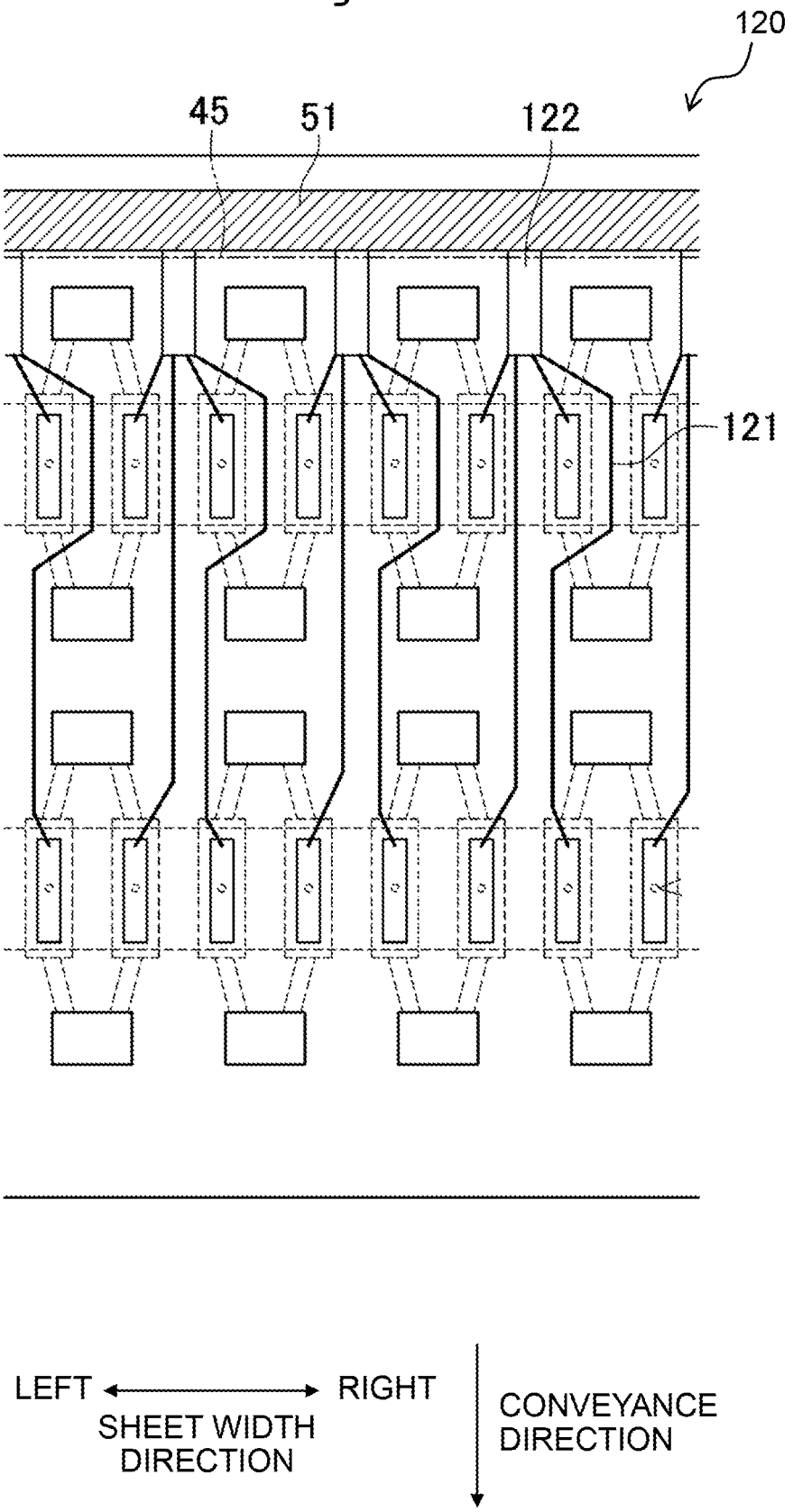
FIG. 9 depicts a head unit 120 according to a third modified embodiment and FIG. 9 corresponds to FIG. 4.

In a head unit 120 according to a third modified embodiment, as depicted in FIG. 9, four of lower traces 121 arranged adjacently to each other in the sheet width direction are combined in the vicinity of the upstream end in the conveyance direction to form a coupling trace 122. The width of the coupling trace 122 is larger than the total width of the four lower traces 121. Each of the coupling traces 122 is connected to the common terminal 51.

When compared to the case in which each of the lower traces 121 is separately connected to the common terminal 51, forming the coupling trace 122 by connecting multiple lower traces 121 that are connected to the lower electrodes 42 kept at a constant potential enables a simpler arrangement or layout of traces.

Since the width of the coupling trace 122 is larger than the total width of the four lower traces 121, the dimension of the portion conducted to each lower electrode 42 is larger than that of the case in which each of the lower traces 121 is separately connected to the common terminal 51. This stabilizes the potential of the lower electrodes 42.

In the third modified embodiment, the width of the coupling trace 122 is larger than the total width of the four lower traces 121. The present disclosure, however, is not limited thereto. For example, the width of the coupling trace 122 may be equal to or less than the total width of the four lower traces 121. For example, the width of the coupling trace 122 may be substantially the same as the width of one lower trace 121.

In the above embodiment, the lower traces 48 connected to the lower electrodes 42 and the upper traces 43 connected to the upper electrodes 42 are arranged on mutually different surfaces. The present disclosure, however, is not limited thereto.

For example, a part of the traces connected to the lower electrodes may be arranged on a certain surface and the other part of the traces connected to the lower electrodes may be arranged on a different surface different from the certain surface. Further, a part of the traces connected to the upper electrodes may be arranged on a certain surface and the other part of the traces connected to the upper electrodes may be arranged on the different surface.

Figure 10:
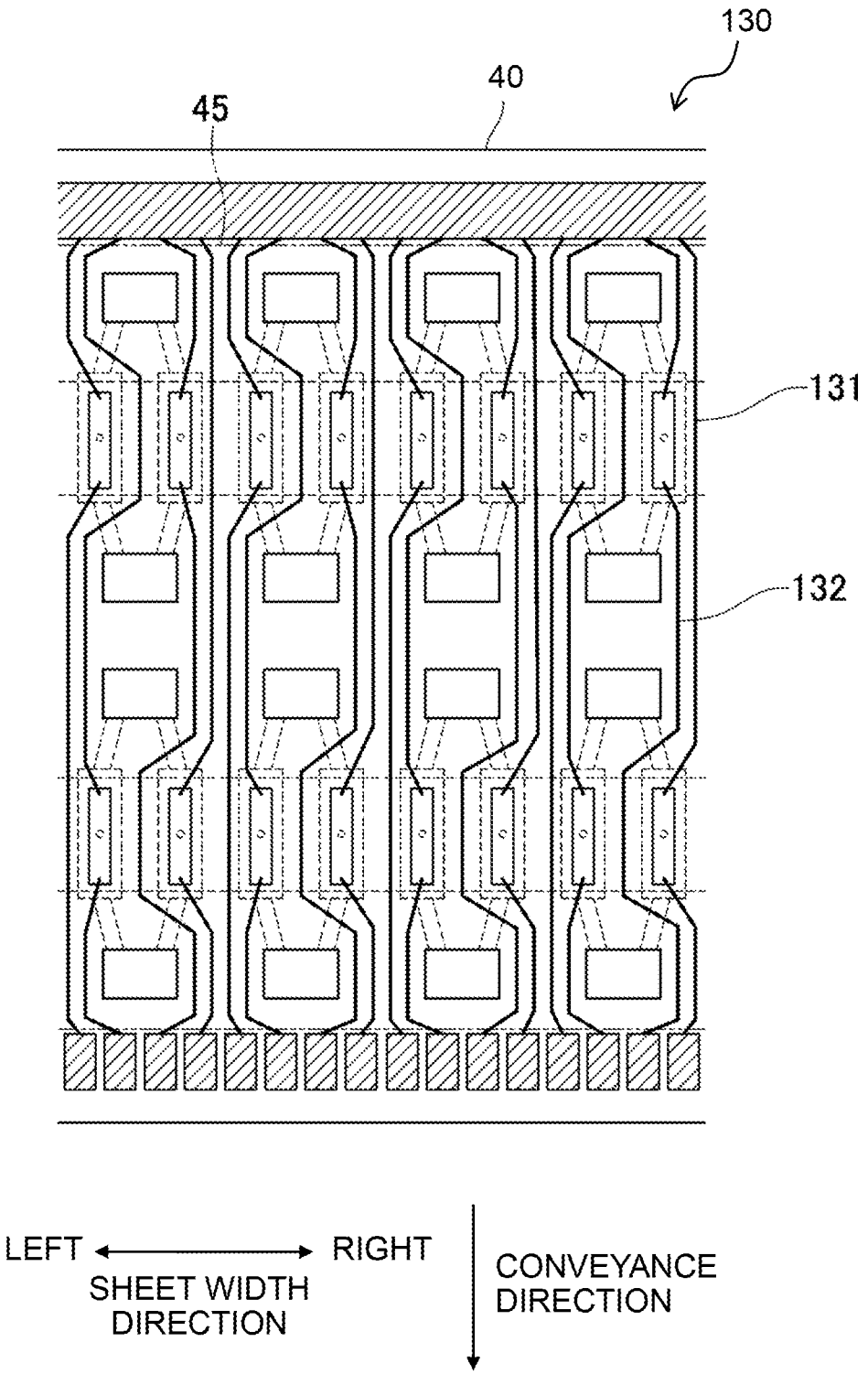
FIG. 10 depicts a head unit 130 according to a fourth modified embodiment and FIG. 10 corresponds to FIG. 4.

All the traces connected to the lower electrodes and the upper electrodes may be arranged on the same surface. For example, in a head unit 130 according to a fourth modified embodiment, as depicted in FIG. 10, traces 131 connected to the lower electrodes 42 and traces 132 connected to the upper electrodes 43 are arranged on a surface between the vibration film 40 and the protection film 45. The positions in the sheet width direction and the conveyance direction of the traces 131 and 132 are similar to those of the traces 48 and 49 according to the above embodiment.

In the fourth modified embodiment, the traces 131 and 132 are arranged on the surface between the vibration film 40 and the protection film 45. The present disclosure, however, is not limited thereto. The traces connected to the lower electrodes 42 and the traces connected to the upper electrodes 43 may be arranged on another surface, such as a surface between the protection film 46 and the protection film 47.

In the above embodiment, each of the lower electrodes 42 kept at the ground potential is formed corresponding to one of the pressure chambers 30. Each of the lower electrodes 42 is connected to one of the lower traces 48. The present disclosure, however, is not limited thereto. For example, each of the lower electrodes may be formed corresponding to two or more pressure chambers 30 and one lower trace may be connected to the lower electrode common to the two or more pressure chambers 30.

In the above embodiment, only one trace extends through the area between two pressure chambers 30 adjacent to each other in the sheet width direction. The present disclosure, however, is not limited thereto. For example, two or more of traces may extend through the area between two pressure chambers 30 adjacent to each other in the sheet width direction.

In the above embodiment, each of the upper traces 49 corresponding to the pressure chamber row 8A extends through the area between two pressure chambers 30 that are included in the pressure chambers 30 forming the pressure chamber row 8B and are adjacent to each other in the sheet width direction, and each of the upper traces 49 is connected to one of the individual terminals 52 positioned downstream, in the conveyance direction, of the outflow coupling channels 34 corresponding to the pressure chamber row 8B. The present disclosure, however, is not limited thereto.

For example, first individual terminals may be arranged, in the conveyance direction, upstream of the outflow coupling channels 34 corresponding to the pressure chamber row 8A, and second individual terminals may be arranged, in the conveyance direction, downstream of the outflow coupling channels 34 corresponding to the pressure chamber row 8B. The upper traces 49 corresponding to the pressure chamber row 8A may extend upstream in the conveyance direction from the upper electrodes 43 and may be connected to the first individual terminals. The upper traces 49 corresponding to the pressure chamber row 8B may extend downstream in the conveyance direction from the upper electrodes 43 and may be connected to the second individual terminals. In that case, no upper traces extend through the area between adjacent pressure chambers 30.

In the above embodiment, each of the lower traces 48 corresponding to the pressure chamber row 8B extends through the area between two pressure chambers 30 that are included in the pressure chambers 30 forming the pressure chamber row 8A and are arranged adjacently to each other in the sheet width direction, and each of the lower traces 48 is connected to the common terminal 51 positioned upstream, in the conveyance direction, of the outflow coupling channels 34 corresponding to the pressure chamber row 8A. The present disclosure, however, is not limited thereto.

For example, the first common terminals may be provided upstream, in the conveyance direction, of the outflow coupling channels 34 corresponding to the pressure chamber row 8A, and the second common terminals may be provided downstream, in the conveyance direction, of the outflow coupling channels 34 corresponding to the pressure chamber row 8B. The lower traces 48 corresponding to the pressure chamber row 8A may extend upstream in the conveyance direction from the lower electrodes 42 and may be connected to the first individual terminals. The lower traces 48 corresponding to the pressure chamber row 8B may extend downstream in the conveyance direction from the lower electrodes 42 and may be connected to the second individual terminals. In that case, no lower traces extend through the area between the adjacent pressure chambers 30.

In the above embodiment, the inflow coupling channels 32 are arranged in the sheet width direction at intervals and the outflow coupling channels 34 are arranged in the sheet width direction at intervals. Each of the traces 48 and 49 extends through the area between the adjacent inflow coupling channels 32 and the area between the adjacent outflow coupling channels 34. The present disclosure, however, is not limited thereto. For example, each of the traces 48 and 49 may extend through an area at the outside of the inflow coupling channels 32 in the sheet width direction and an area at the outside of the outflow coupling channels 34 in the sheet width direction.

In the head unit 11 of the embodiment, the color of ink discharged from the nozzles 10 belonging to one of the nozzle rows 9 is different from that discharged from the nozzles 10 belonging to the other. The present disclosure, however, is not limited thereto.

Figure 11:
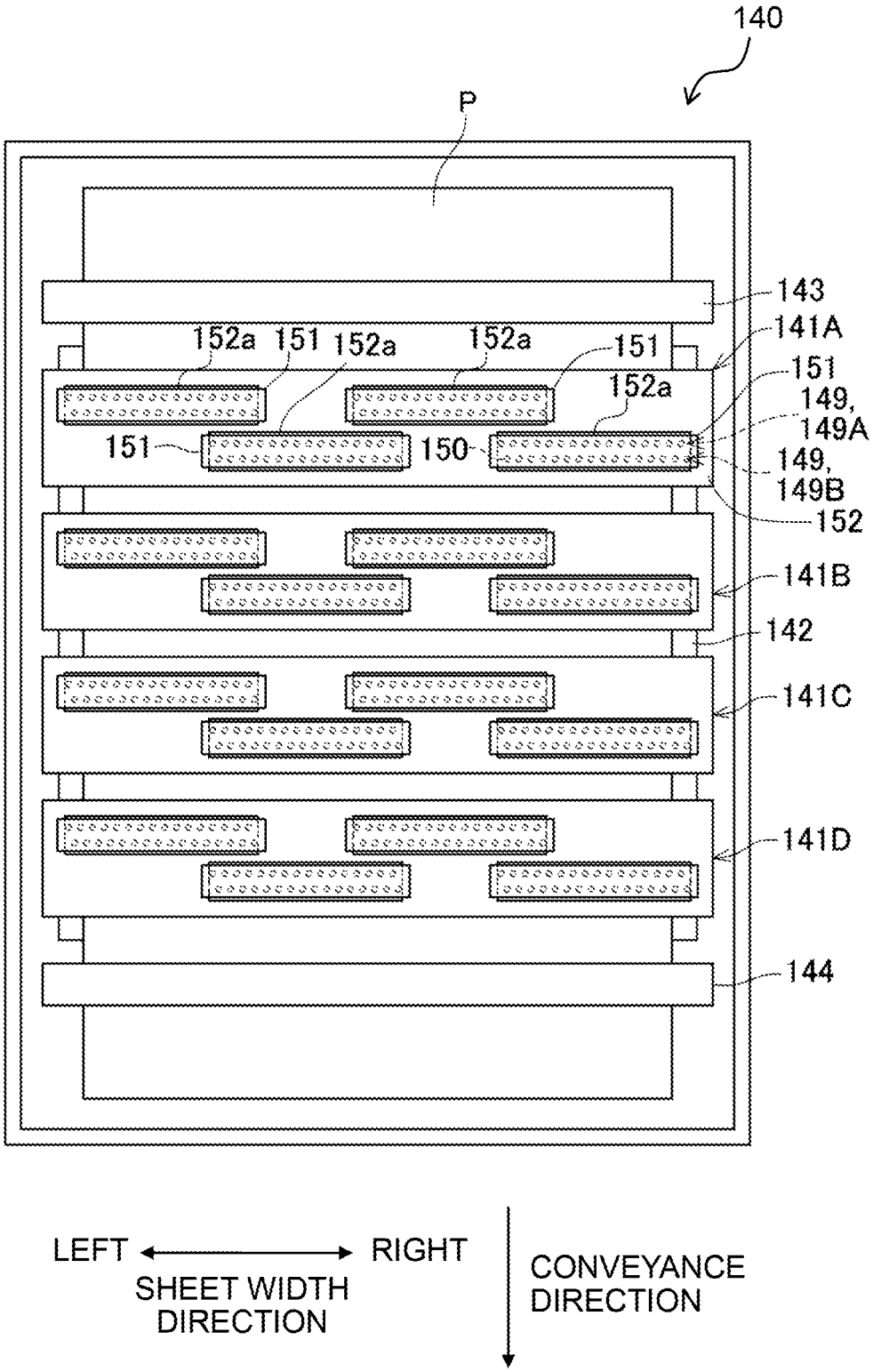
FIG. 11 depicts a schematic configuration of a printer 140 according to a fifth modified embodiment.

For example, as depicted in FIG. 11, a printer 140 according to a fifth modified embodiment includes four ink-jet heads 141K, 141Y, 141C, and 141M, a platen 142, and conveyance rollers 143 and 144. The ink-jet heads 141K, 141Y, 141C, and 141M are arranged in that order from the upstream side in the conveyance direction. Each of the ink-jet heads 141K, 141Y, 141C, and 141M includes four head units 151 and a holding member 152.

A lower surface of each head unit 151 is provided with nozzles 151. The nozzles 150 are aligned in the sheet width direction to form a nozzle row 149, and each head unit 151 includes two nozzle rows 149 arranged in the conveyance direction. Positions in the sheet width direction of the nozzles 10 belonging to one of the two nozzle rows 149 are different from those belonging to the other by half of the length between the nozzles 150 of each nozzle row 149.

In the ink-jet heads 141K, 141Y, 141C, and 141M, black (K), yellow (Y), cyan (C), and magenta (M) inks are respectively discharged from all the nozzles 150 forming the two nozzle rows 149. Namely, the kind of ink discharged from the nozzles 150 belonging to one of the two nozzle rows 149 is the same as that discharged from the nozzles 150 belonging to the other.

In the ink-jet heads 141K, 141Y, 141C, and 141M, two of the four head units 151 are arranged in the sheet width direction at an interval. The two of the four head units 151 arranged adjacently to each other in the sheet width direction and the remaining two head units 151 are arranged in the conveyance direction at an interval. The two head units 151 arranged at the upstream side in the conveyance direction are shifted in the sheet width direction from the two head units 151 arranged at the downstream side in the conveyance direction. In that configuration, the nozzles 150 of the four head units 151 are arranged to cover the entire length in the sheet width direction of the recording sheet P. Part of the nozzles 150 arranged on one side (right in FIG. 11) in the sheet width direction of the head unit 151 disposed at the upstream side in the conveyance direction overlap in the conveyance direction with part of the nozzles 150 arranged on the other side (left in FIG. 11) in the in the sheet width direction of the head unit 151 disposed at the downstream side in the conveyance direction.

The holding member 152 is a rectangular plate member that extends to cover the entire length in the sheet width direction of the recording sheet P. The holding member 152 has four through holes 152*a* corresponding to the four head units 151. The nozzles 150 of each of the head units 151 are exposed to the lower side in the up-down direction (recording sheet P side) via the corresponding one of the through holes 152*a*.

The platen 142 is disposed below the ink-jet heads 141K, 141Y, 141C, and 141M to face the nozzles 150 of the ink-jet heads 141K, 141Y, 141C, and 141M. The platen 142 supports the recording sheet P from below.

The conveyance roller 143 is disposed upstream, in the conveyance direction, of the ink-jet heads 141K, 141Y, 141C, and 141M and the platen 142. The conveyance roller 144 is disposed downstream, in the conveyance direction, of the ink-jet heads 141K, 141Y, 141C, and 141M and the platen 142. The conveyance rollers 143 and 144 convey the recording sheet P in the conveyance direction.

<Head Unit 151>

Figure 12:
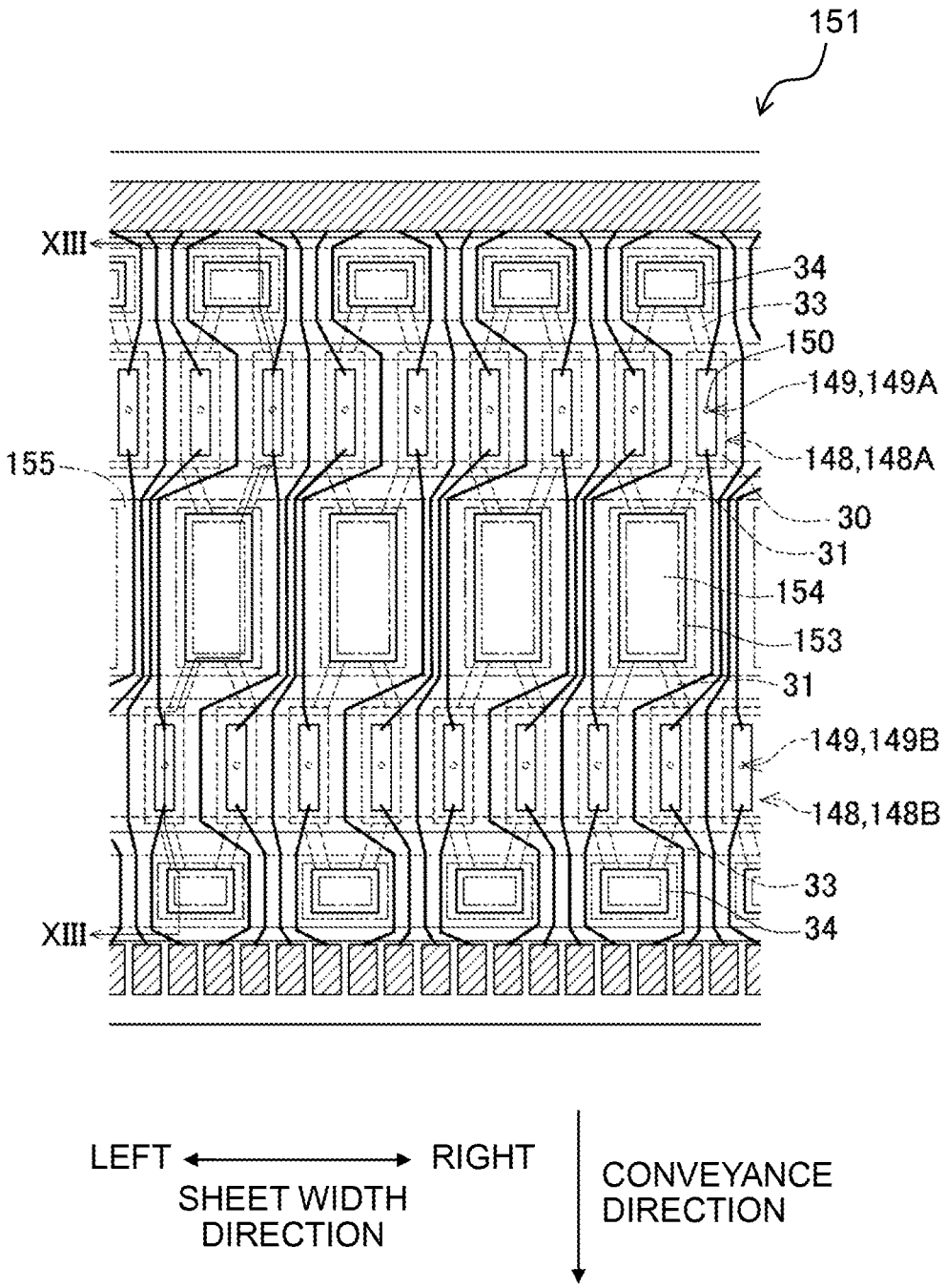
FIG. 12 is a plan view of a head unit 151 depicted in FIG. 11 and FIG. 12 corresponds to FIG. 2.
Figure 13:
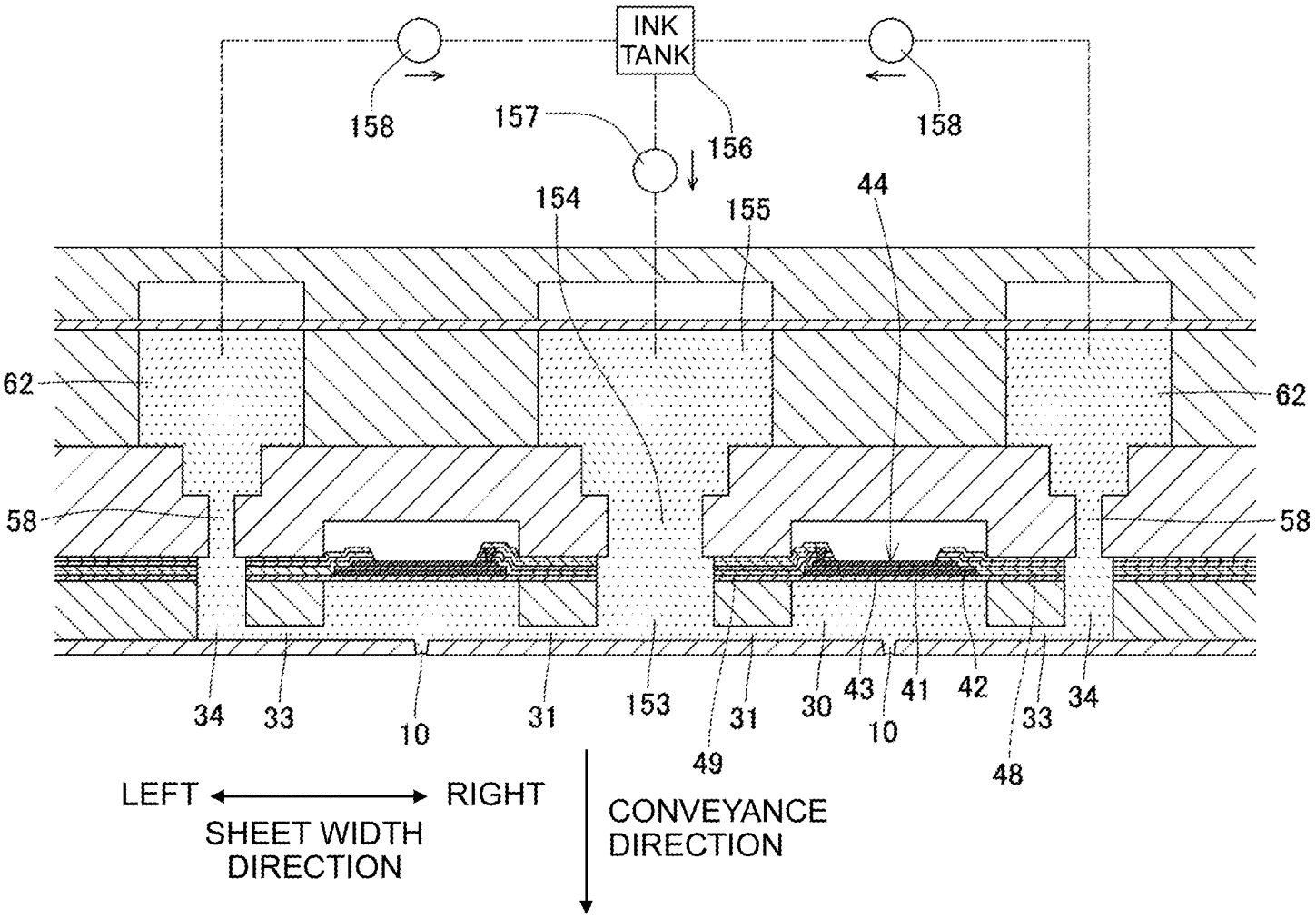
FIG. 13 is a cross-sectional view along lines XIII-XIII in FIG. 12.

Subsequently, each head unit 151 is explained in detail. Similar to the head unit 11, the head unit 151 includes ink channels, the piezoelectric actuator, traces, and the like as depicted in FIGS. 12 and 13. In the head unit 151, since the positions in the sheet width direction of the nozzles 150 belonging to one of the two nozzle rows 149 are different from those belonging to the other, the positions in the sheet width direction of the corresponding pressure chambers 30, inflow throttle channels 31, outflow throttle channels 33, outflow coupling channels 34, outflow connecting channels 58, driving elements 44, and the like of the nozzle row 149 disposed at the upstream side in the conveyance direction (hereinafter referred to as a nozzle row 149A) are different from those of the nozzle row 149 disposed at the downstream side in the conveyance direction (hereinafter referred to as a nozzle row 149B). In the head unit 151, multiple pressure chambers 30 form two pressure chamber rows 148 corresponding to the two nozzle rows 149. In the following, one of the pressure chamber rows 148 corresponding to the nozzle row 149A may be referred to as a pressure chamber row 148A, and the other corresponding to the nozzle row 149B may be referred to as a pressure chamber row 148B. FIG. 13 is not a cross section taken along one plane, as indicated by the lines XIII-XIII in FIG. 12.

Unlike the head unit 11, the head unit 151 is provided with inflow inflow coupling channels 153 (hereinafter referred to as inflow coupling channels 153) disposed between the pressure chamber rows 148A and 148B in the conveyance direction, extending in the up-down direction, and arranged to form one row in the sheet width direction. Each inflow coupling channel 153 is connected to two of the inflow throttle channels 31 that correspond to the pressure chamber row 148A and are adjacent to each other in the sheet width direction and two of the inflow throttle channels 31 that correspond to the pressure chamber row 148*b* and are adjacent to each other in the sheet width direction. Namely, each inflow coupling channel 153 is connected to the four inflow throttle channels 31 in total. Each inflow coupling channel 153 is connected to an inflow manifold 155 via an inflow inflow connecting channel 154.

The inflow manifold 155 and the two outflow manifolds 62 are connected to the same ink tank 156 via channels (not depicted). A supply pump 157, which supplies ink from the ink tank 156 to the inflow manifold 155, is provided in a channel between the inflow manifold 155 and the ink tank 156. A discharge pump 158, which sends ink from each outflow manifold 62 to the ink tank 156, is provided in a channel between each outflow manifold 62 and the ink tank 156.

In the fifth modified embodiment, the inflow throttle channels corresponding to the two pressure chamber rows 148A and 148B may be drawn out between the pressure chamber rows 148A and 148B. In that configuration, each inflow coupling channel 153 may be common to the two pressure chamber rows 148A and 148B.

Unlike the fifth modified embodiment, when each of the inflow coupling channels is formed corresponding to one of the pressure chamber rows 148, partitions partitioning the inflow coupling channels are required to be provided. On the other hand, in the fifth modified embodiment, each inflow coupling channel is common to the two pressure chamber rows 148. The fifth modified embodiment thus requires no portions corresponding to the partitions, making it possible to make the volume (the dimension as viewed in the up-down direction) of each inflow coupling channel 153 provided for the inflow throttle channels 31 corresponding to the two pressure chamber rows 148 larger than the total volume (the total dimension as viewed in the up-down direction) of the inflow coupling channels each of which is formed corresponding to one of the pressure chamber rows 148.

In the fifth modified embodiment, both the supply pump 157 and two discharge pumps 158 are provided. The present disclosure, however, is not limited thereto. Only the supply pump 157 may be provided, or only the two discharge pumps 158 may be provided.

In the fifth modified embodiment, each of the discharge pumps 158 is provided corresponding to one of the two outflow manifolds 62. The present disclosure, however, is not limited thereto. For example, two channels connecting the two outflow manifolds 62 and the ink tank 156 may be joined to each other in their middle portion and then connected to the ink tank 156. The discharge pump 158 may be provided at the portion at which the two channels are coupled to each other.

Unlike the fifth modified embodiment, multiple inflow coupling channels may be provided respectively for the nozzle rows 149A and 149B at the outside in the conveyance direction of the pressure chamber rows 148A and 148B of the head unit 151, and multiple outflow coupling channels may be common to the pressure chamber rows 148A and 148B so that the outflow coupling channels are positioned between the pressure chamber rows 148A and 148B in the sheet width direction.

In that configuration, outflow throttle channels corresponding to the two pressure chamber rows 148A and 148B may be drawn out between the pressure chamber rows 148A and 148B so that the outflow coupling channels may be common to the two pressure chamber rows 148A and 148B.

Further, the volume (the dimension as viewed in the up-down direction) of each outflow coupling channel provided for the outflow throttle channels 33 corresponding to the two pressure chamber rows 148A and 148B may be larger than the total volume (the total dimension as viewed in the up-down direction) of the outflow coupling channels each of which is provided corresponding to one of the pressure chamber rows 148.

Figure 14:
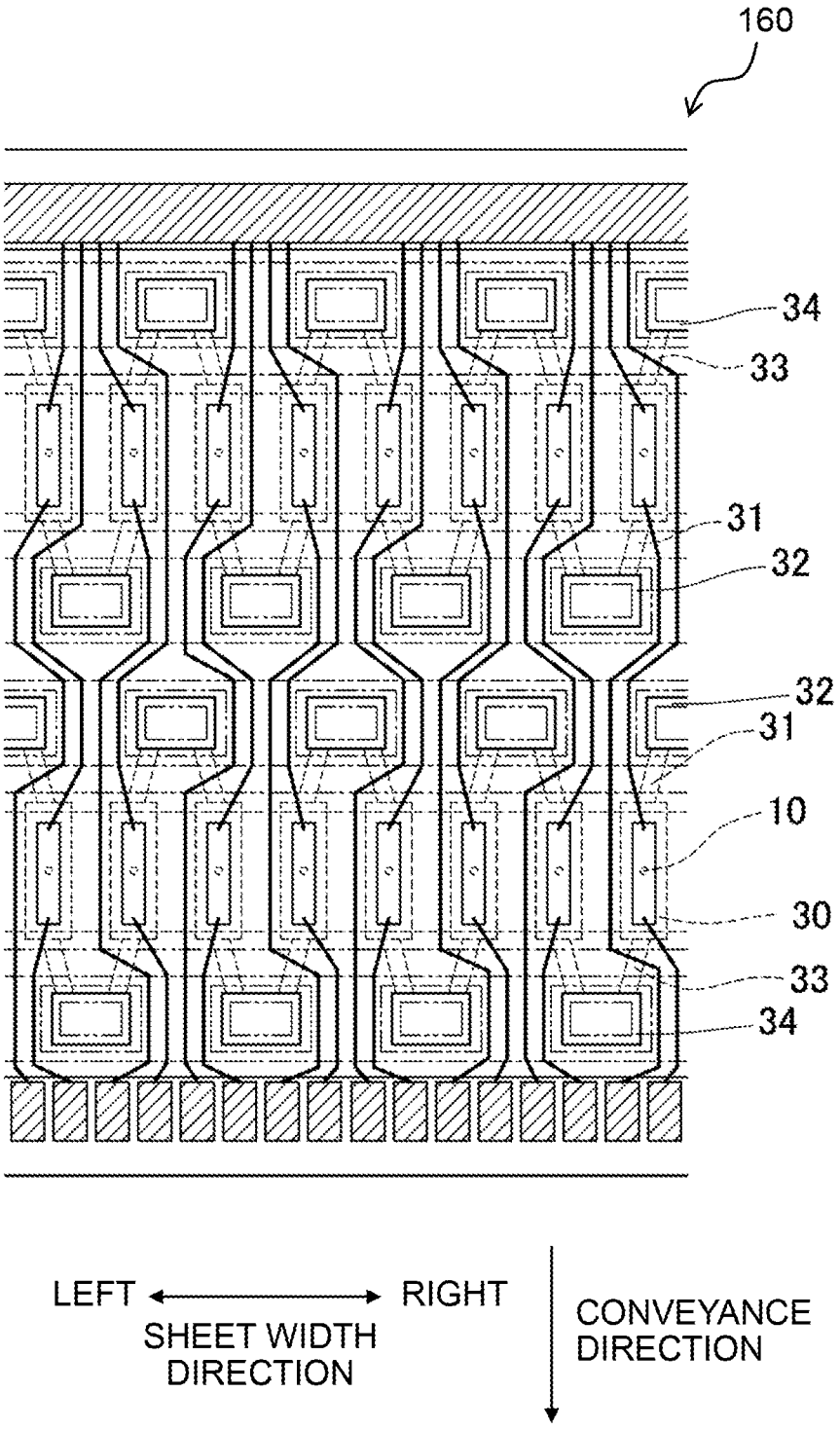
FIG. 14 is a plan view of a head unit 160 according to a sixth modified embodiment and FIG. 14 corresponds to FIG. 2.

In the above embodiment, two pressure chambers 30 connected to one inflow coupling channel 32 are connected to one outflow coupling channel 34. The present disclosure, however, is not limited thereto. For example, in a head unit 160 according to a sixth modified embodiment depicted in FIG. 14, two inflow throttle channels 31 connected to the inflow coupling channel 32 are shifted in the sheet width direction from two outflow throttle channels 33 connected to the outflow coupling channel 34 by an amount corresponding to one pressure chamber 30. Namely, assuming that N is a natural number equal to or more than 2, the N-th inflow throttle channel 31 and the (N+1)-th inflow throttle channel 31 from the left side in the sheet width direction are connected to a common inflow coupling channel 32; the (N−1)-th outflow throttle channel 33 and the N-th outflow throttle channel 33 from the left side in the sheet width direction are connected to a common outflow coupling channel 34; and the (N+1)-th outflow throttle channel 33 and the (N+2)-th outflow throttle channel 33 from the left side in the sheet width direction are connected to a common outflow coupling channel 34.

In the configuration according to the sixth modified embodiment, the outflow throttle channel 33 connected to the pressure chamber 30, to which one of the two inflow throttle channels 31 connected to the common inflow coupling channel 32 is connected, and the outflow throttle channel 33 connected to the pressure chamber 30, to which the other of the two inflow throttle channels 31 connected to the common inflow coupling channel 32 is connected, are connected to different outflow coupling channels 34.

For example, the manufacturing error of the channel substrate 22 may occur or the positional shift between the channel substrate 22 and the protection substrate 24 may occur at the time of joining them. In that case, both the positional shift between the inflow coupling channel 32 and the inflow connecting channel 57 and the positional shift between the outflow coupling channel 34 and the outflow connecting channel 58 may be caused, those channels corresponding to one pressure chamber 30. When the above positional shifts occur in the configuration in which two coupling channels 33*r* connected to the pressure chambers 30, to which two inflow throttle channels 31 connected to a common inflow coupling channel 32 are connected, are connected to a common outflow coupling channel 34, the discharge characteristics of ink discharged from the respective nozzles 10 communicating with the two pressure chambers 30 differ greatly from each other owing to the effects of both the positional shift between the inflow coupling channel 32 and the inflow connecting channel 57 and the positional shift between the outflow coupling channel 34 and the outflow connecting channel 58.

When the above positional shifts occur in the configuration according to the sixed modified embodiment, the discharge characteristics of ink discharged from the nozzle 10 communicating with one pressure chamber 30 are affected by both the positional shift between the inflow coupling channel 32 and the inflow connecting channel 57 and the positional shift between the outflow coupling channel 34 and the outflow connecting channel 58 similarly to the above. However, in the sixth modified embodiment, the discharge characteristics of ink discharged from the nozzle 10 communicating with a pressure chamber 30, which is adjacent to said one pressure chamber 30 at a first side in the sheet width direction, are affected by the positional shift between the inflow coupling channel 32 and the inflow connecting channel 57, whereas the discharge characteristics are not affected by the positional shift between the outflow coupling channel 34 and the outflow connecting channel 58. Further, the discharge characteristics of ink discharged from the nozzle 10 communicating with a pressure chamber 30, which is adjacent to said one pressure chamber 30 at a second side in the sheet width direction, are affected by the variation in the area where the outflow coupling channel 34 is connected to the connecting channel 58*r*, whereas the discharge characteristics are not affected by the variation in the area where the inflow coupling channel 32 is connected to the inflow connecting channel 57. Accordingly, in the sixth modified embodiment, the number of nozzles 10 in which the discharge characteristics of ink would greatly depend on the above positional shifts can be reduced, making it possible to reduce the variation in discharge amounts of ink between multiple nozzles 10 as much as possible.

In the above embodiment, the lower end of the inflow connecting channel 57 connected to the opening 32*a* of the inflow coupling channel 32 is positioned at the inside of the edge of the opening 32*a* as viewed in the up-down direction. The present disclosure, however, is not limited thereto. The lower end of the inflow connecting channel 57 may overlap with the edge of the opening 32*a* as viewed in the up-down direction. Or, the lower end of the inflow connecting channel 57 may be positioned at the outside of the edge of the opening 32*a* as viewed in the up-down direction.

Similarly, the lower end of the outflow connecting channel 58 connected to the opening 34*a* of the outflow coupling channel 34 may overlap with the edge of the opening 34*a*. Or, the lower end of the outflow connecting channel 58 may be positioned at the outside of the edge of the opening 34*a* as viewed in the up-down direction.

In the above embodiment, the length Wri in the sheet width direction of the inflow coupling channel 32 is shorter than the length 2×Wc that is twice as long as the length Wc in the sheet width direction of the pressure chamber 30, and corresponding to this, the inflow throttle channel 31 extends while being inclined to the conveyance direction. The present disclosure, however, is not limited thereto. The inflow throttle channel may extend while being bent in the middle thereof. Similarly, the outflow throttle channel may extend while being bent in the middle thereof.

In the above examples, two inflow throttle channels are connected to one inflow coupling channel and two outflow throttle channels are connected to one outflow coupling channel. The present disclosure, however, is not limited thereto. Three or more inflow throttle channels may be connected to one inflow coupling channel, and three or more outflow throttle channels may be connected to one outflow coupling channel.

When N-pieces (N is a natural number equal to or more than 3) of inflow throttle channels are connected to one inflow coupling channel, the length in the sheet width direction of the inflow coupling channel is preferably longer than the length Wc in the sheet width direction of the pressure chamber 30 and shorter than a length N×Wc that is N times as long as the length Wc of the pressure chamber 30. Similarly, when N-pieces of outflow throttle channels are connected to one outflow coupling channel, the length in the sheet width direction of the outflow coupling channel is preferably longer than the length Wc in the sheet width direction of the pressure chamber 30 and shorter than the length N×Wc that is N times as long as the length Wc of the pressure chamber 30.

In those cases, the dimension of the portion of the upper surface of the vibration film 40 joined to the protection substrate 24 is made to be large, making it possible to reliably join the vibration film 40 to the protection substrate 24 with adhesive. Further, the volume of each inflow coupling channel connected to N-pieces of inflow throttle channels corresponding to N-pieces of pressure chambers 30 is sufficient for the N-pieces of inflow throttle channels. Furthermore, the volume of each outflow coupling channel connected to N-pieces of outflow throttle channels corresponding to N-pieces of pressure chambers 30 is sufficient for the N-pieces of outflow throttle channels.

Or, the length in the sheet width direction of the inflow coupling channel may be equal to or less than the length Wc of the pressure chamber 30. Or, the length in the sheet width direction of the outflow coupling channel may be equal to or less than the length Wc of the pressure chamber 30.

The examples in which the present disclosure is applied to the ink-jet head having each head unit that circulates ink between itself and the ink tank are explained above. The present disclosure, however, is not limited thereto. The head unit may include no channels through which ink returns to the ink tank. For example, the head unit may be a head unit in which the outflow throttle channels 33, the outflow coupling channels 34, the outflow connecting channels 58, the outflow manifolds 62 are removed from the head unit 11 of the above embodiment.

The examples in which the present disclosure is applied to the ink-jet head discharging ink from nozzles are explained above. The present disclosure, however, is not limited thereto. For example, the present disclosure is applicable to a liquid discharge head discharging any other liquid than ink, such as metal or resin in liquid form.

What is claimed is:

1. A liquid discharge head comprising a first channel member including a liquid channel, wherein the liquid channel includes:

a plurality of pressure chambers connected respectively to a plurality of nozzles and arranged in a first direction;

a plurality of throttle channels connected to the pressure chambers and extending from connection portions of the pressure chambers to provide fluid flow in a second direction, which is orthogonal to the first direction; and a plurality of coupling channels arranged in the first direction, each of the coupling channels being connected to two or more of the throttle channels that are adjacent to each other in the first direction, extending in a third direction orthogonal to the first direction and the second direction, having a plurality of openings in a surface in the third direction of the first channel member.

2. The liquid discharge head according to claim 1, wherein the coupling channels are connected to N pieces of the throttle channels adjacent to each other in the first direction, and the coupling channels are longer in the first direction than the pressure chambers and shorter in the first direction than a length that is N times the length in the first direction of each of the pressure chambers.

3. The liquid discharge head according to claim 2, wherein each of the throttle channels extends in the second direction while being inclined thereto so that each of the throttle channels extends toward an inside in the first direction of one of the coupling channels as each of the throttle channels approaches the one of the coupling channels in the second direction.

4. The liquid discharge head according to claim 1, further comprising a second channel member that is joined to the surface of the first channel member and includes a plurality of connecting channels connecting the openings of the coupling channels to a common channel that is common to the coupling channels, wherein a connection portion of each of the connecting channels with one of the openings is positioned inside an edge of the one of the openings as viewed in the third direction.

5. The liquid discharge head according to claim 1, wherein the throttle channels include:

a plurality of inflow throttle channels extending from the connection portions with the pressure chambers toward the first side in the second direction and through which the liquid flows into the pressure chambers, and a plurality of outflow throttle channels extending from the connection portions with the pressure chambers toward a second side in the second direction and through which the liquid flows out of the pressure chambers, wherein the coupling channels include:

a plurality of inflow coupling channels arranged in the first direction and connected to two or more of the inflow throttle channels arranged adjacently to each other in the first direction; and a plurality of outflow coupling channels arranged in the first direction and connected to two or more of the outflow throttle channels arranged adjacently to each other in the first direction.

6. The liquid discharge head according to claim 5, wherein the first channel member includes two pressure chamber rows arranged adjacently to each other in the second direction, each of the two pressure chamber rows is formed by arranging the pressure chambers in the first direction, a kind of the liquid discharged from the nozzles corresponding to one of the two pressure chamber rows is identical to a kind of the liquid discharged from the nozzles corresponding to the other of the two pressure chamber rows, the inflow throttle channels corresponding to the two pressure chamber rows extend through an area between the two pressure chamber rows in the second direction, and the inflow coupling channels arranged in the first direction and connected to the two or more of the throttle channels corresponding to the two pressure chamber rows are arranged in the area between the two pressure chamber rows in the second direction.

7. The liquid discharge head according to claim 5, wherein the first channel member includes a plurality of pressure chamber rows arranged adjacently to each other in the second direction, each of the pressure chamber rows is formed by arranging the pressure chambers in the first direction, the outflow throttle channels corresponding to two of the pressure chamber rows arranged adjacently to each other extend through an area between the two of the pressure chamber rows in the second direction, and the outflow coupling channels arranged in the first direction and connected to the two or more of the outflow throttle channels corresponding to the two of the pressure chamber rows are arranged in the area between the two pressure chamber rows in the second direction.

8. The liquid discharge head according to claim 5, wherein each of the inflow coupling channels is connected to two of the inflow throttle channels arranged adjacently to each other in the first direction, each of the outflow coupling channels is connected to two of the inflow throttle channels arranged adjacently to each other in the first direction, one of the outflow throttle channels connected to the pressure chamber corresponding to one of the two inflow throttle channels that is connected to an identical inflow coupling channel included in the inflow coupling channels and one of the outflow throttle channels connected to the pressure chamber corresponding to the other of the two inflow throttle channels that is connected to the identical inflow coupling channel are connected to mutually different outflow coupling channels included in the outflow coupling channels.

9. The liquid discharge head according to claim 1, comprising:

a plurality of driving elements provided corresponding to the pressure chambers and configured to apply pressure to the liquid in the pressure chambers, and a plurality of traces connected to the driving elements, wherein the coupling channels are arranged in the first direction, and the traces extend through an area of the first channel member between the coupling channels arranged adjacently to each other in the first direction.

10. The liquid discharge head according to claim 9, comprising:

a first pressure chamber row formed by arranging the pressure chambers in the first direction, a second pressure chamber row formed by arranging the pressure chambers in the first direction and arranged adjacently to the first pressure chamber row in the second direction, and a terminal connected to the traces and arranged such that the first pressure chamber row is arranged between the second pressure chamber row and the terminal in the second direction, wherein the traces connected to the driving elements that are provided corresponding to the pressure chambers forming the second pressure chamber row extend through an area between two of the pressure chambers that form the first pressure chamber row and are arranged adjacently to each other in the first direction to arrive at the terminal.

11. The liquid discharge head according to claim 10, wherein only one of the traces extends through the area of the first channel member between the pressure chambers arranged adjacently each other in the first direction.

12. The liquid discharge head according to claim 9, wherein each of the driving elements includes a piezoelectric body, at least one first electrode disposed on a first surface in the third direction of the piezoelectric body, and at least one second electrode disposed on a second surface in the third direction of the piezoelectric body, the at least one first electrode includes a plurality of first electrodes and the at least one second electrode includes a plurality of second electrodes, and the traces include:

a plurality of first traces provided respectively for the first electrodes corresponding to the driving elements and connected to the first electrodes; and a plurality of second traces provided respectively for the second electrodes corresponding to the driving elements and connected to the second electrodes.

13. The liquid discharge head according to claim 12, wherein the first traces and the second traces are arranged on mutually different surfaces.

14. The liquid discharge head according to claim 12, comprising a driver IC configured to supply constant potential to the at least one first electrode, and two or more of the first traces are arranged on an identical surface and are connected to each other.

15. The liquid discharge head according to claim 14, wherein a width of a connection portion where the two or more of the first traces are connected to each other is larger than a total width of portions of the first traces, the first traces being not connected to each other at the portions of the first traces.

16. The liquid discharge head according to claim 9, wherein an external form of each of the openings as viewed in the third direction is a rectangle in which at least one of corners is chamfered.

17. The liquid discharge head according to claim 16, wherein the traces extend while being inclined to the first direction and the second direction along the chamfered portions of the openings that are inclined to the first direction and the second direction.

18. The liquid discharge head according to claim 9, wherein an external form of each of the openings as viewed in the third direction is a polygon having sides inclined to the first direction and the second direction.

* * * * *